US006118961A

United States Patent [19]

Nomura et al.

[11] Patent Number: 6,118,961

[45] **Date of Patent: *Sep. 12, 2000**

[54] DETACHABLE TWO-FRAME PROCESS CARTRIDGE FOR AN IMAGE FORMING APPARATUS

[75] Inventors: Yoshiya Nomura, Tokyo; Tadayuki Tsuda, Kawasaki; Shinichi Sasaki, Fujisawa; Isao Ikemoto, Kawasaki; Kazushi Watanabe, Yokohama; Hiroyuki Shirai; Toshiyuki Karakama, both of Tokyo, all of Japan

[73] Assignee: Canon Kabushiki Kaisha, Tokyo, Japan

[ * ] Notice: This patent is subject to a terminal disclaimer.

[21] Appl. No.: 08/891,979

[22] Filed: Jul. 11, 1997

Related U.S. Application Data

[63] Continuation of application No. 08/789,604, Jan. 24, 1997, abandoned, which is a continuation of application No. 08/170,908, Dec. 21, 1993, abandoned, which is a continuation of application No. 08/068,287, May 28, 1993, Pat. No. 5,294,960, which is a continuation of application No. 07/785,401, Oct. 30, 1991, abandoned, which is a continuation-in-part of application No. 07/689,517, Apr. 23, 1991, Pat. No. 5,208,634.

[30] Foreign Application Priority Data

| | | | |
|---|---|---|---|
| Nov. 6, 1990 | [JP] | Japan | 2-301779 |
| Mar. 19, 1991 | [JP] | Japan | 3-054446 |

[51] Int. Cl.[7] ..... G03G 21/18

[52] U.S. Cl. ..... 399/113; 359/109; 29/469

[58] Field of Search ..... 399/111, 112, 399/113, 114, 109; 29/402.03, 426.6, 469

[56] References Cited

U.S. PATENT DOCUMENTS

| | | | |
|---|---|---|---|
| 4,386,838 | 6/1983 | Hirabayashi | 355/200 |
| 4,500,195 | 2/1985 | Hosono | 355/208 |
| 4,605,299 | 8/1986 | Mochimaru | 355/3 R |
| 4,708,455 | 11/1987 | Kubota et al. | 355/211 |
| 4,757,344 | 7/1988 | Idenawa et al. | 355/3 R |
| 4,816,877 | 3/1989 | Keen | 355/206 |
| 4,851,960 | 7/1989 | Nakamura et al. | 361/255 |
| 4,862,212 | 8/1989 | Tanzawa et al. | 355/245 |
| 4,866,482 | 9/1989 | Hirasawa et al. | 355/260 |

(List continued on next page.)

FOREIGN PATENT DOCUMENTS

| | | | |
|---|---|---|---|
| 0276192 | 7/1988 | European Pat. Off. . | |
| 0276910 | 8/1988 | European Pat. Off. . | |
| 0330225 | 8/1989 | European Pat. Off. . | |
| 0368346 | 5/1990 | European Pat. Off. . | |
| 2611930 | 9/1988 | France . | |
| 8716525 U | 1/1988 | Germany . | |
| 8907136 U | 7/1989 | Germany . | |
| 4003695A1 | 8/1990 | Germany . | |
| 58-21262 | 2/1983 | Japan . | |
| 60-168159 | 8/1985 | Japan | 355/210 |
| 2123376 | 5/1990 | Japan . | |
| 2163769 | 6/1990 | Japan . | |
| 2168277 | 6/1990 | Japan . | |
| 2-257146 | 10/1990 | Japan | 355/210 |
| 2074095 | 10/1981 | United Kingdom . | |

OTHER PUBLICATIONS

Korean Industrial Property Office Official Communication dated Oct. 25, 1994.

European Search Report dated Jul. 8, 1994.

English Translation of Chinese Patent Application Search Report.

European Search Report.

*Primary Examiner*—John Pendegrass

*Attorney, Agent, or Firm*—Fitzpatrick, Cella, Harper & Scinto

[57] ABSTRACT

A process cartridge detachably mountable to an image forming apparatus includes an image bearing member; process device actable on the image bearing member; a first frame containing the image bearing member and the process device; and a second frame engageable with and disengageable from the first frame and containing a developer container.

125 Claims, 15 Drawing Sheets

U.S. PATENT DOCUMENTS

| | | | |
|---|---|---|---|
| 4,924,267 | 5/1990 | Yoshikawa et al. | 355/210 |
| 4,974,020 | 11/1990 | Takamatsu et al. | 355/208 |
| 4,974,023 | 11/1990 | Aimoto et al. | 355/245 |
| 4,987,446 | 1/1991 | Mochimaru et al. | 355/200 |
| 4,996,566 | 2/1991 | Morita et al. | 355/246 |
| 5,036,358 | 7/1991 | Yoshida | 355/203 |
| 5,051,778 | 9/1991 | Watanabe et al. | 355/200 |
| 5,115,272 | 5/1992 | Ohmori et al. | 355/200 |
| 5,160,963 | 11/1992 | Haneda et al. | 355/200 |
| 5,272,505 | 12/1993 | Shishido et al. | 355/219 |
| 5,294,960 | 3/1994 | Nomura et al. | 355/210 |

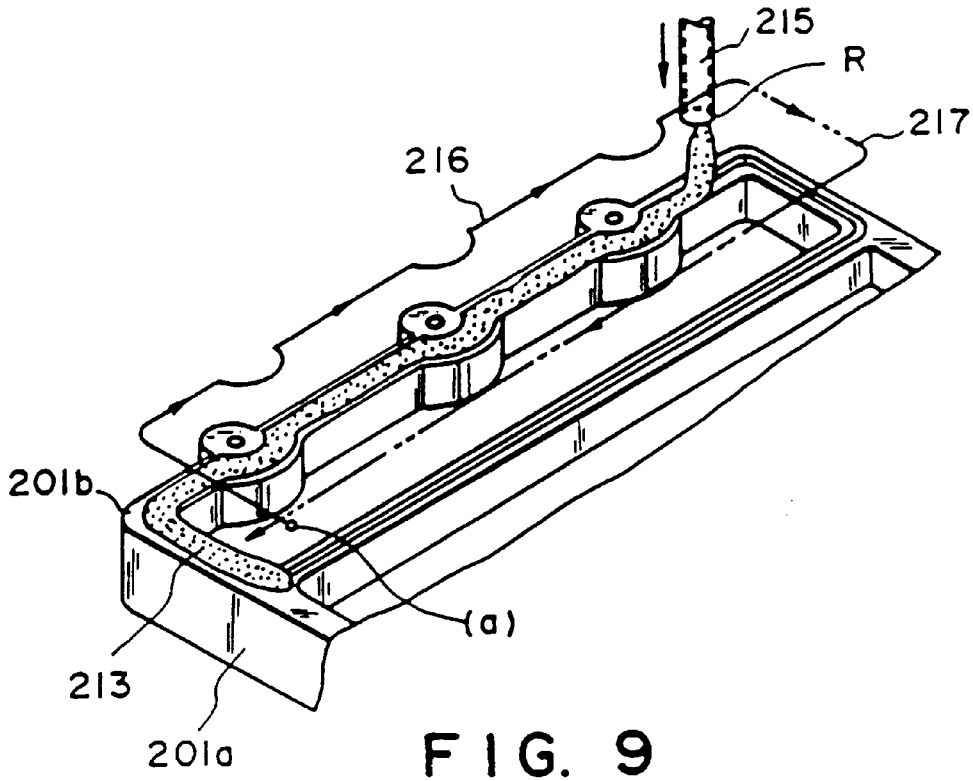
FIG. 9
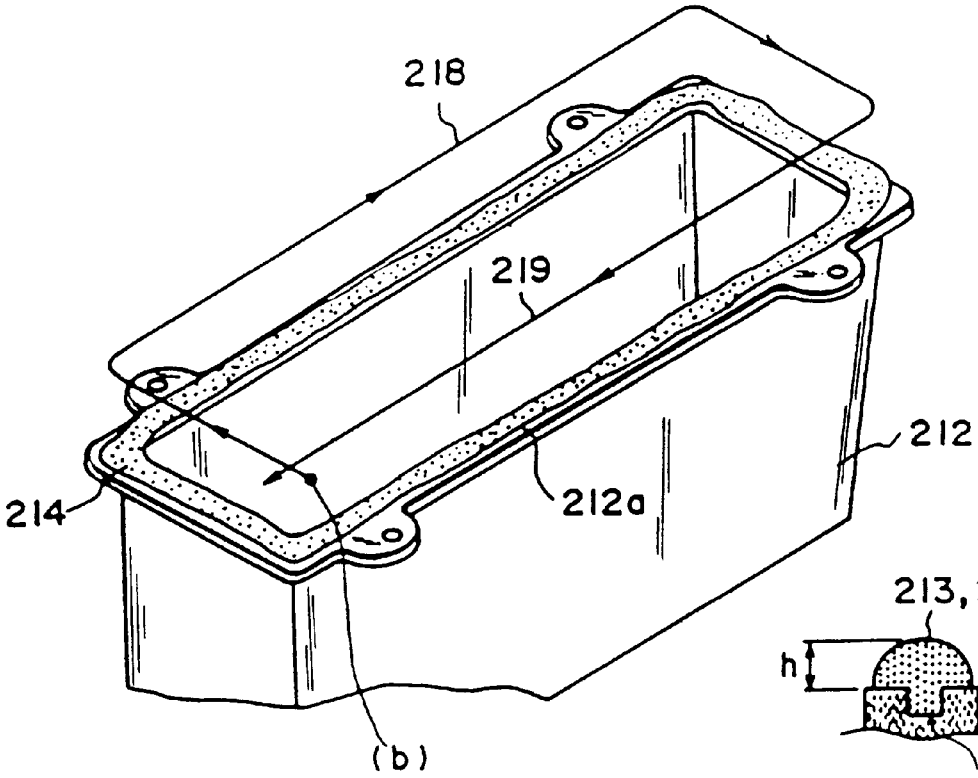
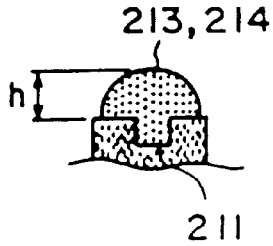
FIG. 10 FIG. 11

DETACHABLE TWO-FRAME PROCESS CARTRIDGE FOR AN IMAGE FORMING APPARATUS

This application is a continuation of application Ser. No. 08/789,604 filed Jan. 24, 1997, now abandoned, which is a continuation of application Ser. No. 08/170,908 filed Dec. 21, 1993, now abandoned, which is a continuation of application Ser. No. 08/068,287 filed May 28, 1993, now U.S. Pat. No. 5,294,960, which is a continuation of application Ser. No. 07/785,401, filed Oct. 30, 1991, now abandoned, which is a continuation-in-part of 07/689,517, filed Apr. 23, 1991, now U.S. Pat. No. 5,208,634.

FIELD OF THE INVENTION AND RELATED ART

The present invention relates to a process cartridge and an image forming apparatus to which the process cartridge is detachably mountable. The image forming apparatus may be in the form of an electrophotographic machine, electrostatic recording machine such as a copying machine or laser beam printer.

Image forming machines such as copying machine require maintenance and servicing operations after they are operated for a long period of time, including replacement of an image bearing member (photosensitive drum), replacement of the developing device or replenishment of the developer (toner), cleaning of a discharging wire of a charging device, replacement of cleaning device filled with the residual toner and adjustment or replacement of some elements around the photosensitive drum.

However, the maintenance and servicing operations require expert knowledge and skill, and therefore, have not been easy for ordinary users.

In consideration of the situation, a process cartridge structure has been proposed in which a process cartridge contains as a unit the photosensitive drum and process means such as a developing device, a charging device, the cleaning device or the like. The process cartridge as a unit is detachably mountable to a main assembly of the image forming apparatus. If the maintenance or servicing operations are necessary in the process means, the entire process cartridge is replaced with a fresh cartridge so that the necessity for the maintenance and servicing operations are eliminated.

Referring first to FIG. 17, there is shown a structure of such a process cartridge. It comprises a photosensitive drum 10, and a cleaning device 13 and a developing device 11 which sandwich the photosensitive drum 10. Substantially above the developing device 11, there is a toner container 110 which is coupled with the developing device 11. Substantially above the photosensitive drum 10, there is a charging device 12. The cleaning device 13 functions to remove the residual toner from the peripheral surface of the photosensitive drum 10 so as to prepare the photosensitive drum 10 for the next image forming operation. The cleaning device 13 comprises a cleaner container 13*a* for accommodating removed residual toner, a cleaning blade 131 for scraping the residual toner off the peripheral surface of the photosensitive drum 10, a toner receiving sheet 132 for receiving the toner scraped by the cleaning blade 131 and for directing it into the cleaner container 13*a*, and a stirring member (not shown) for conveying the toner received by the cleaner container 13*a* to the inside thereof.

The developing device 11 functions to supply the toner to the electrostatic latent image of the photosensitive drum 10 to visualize it. The developing device 11 comprises a developer container 11*a*, a developing sleeve 112 for supplying the toner to the peripheral surface of the photosensitive drum 10, a developing blade 11*b* in sliding contact to the developing sleeve 112 to triboelectrically charge the toner and to form on the developing sleeve 112 a toner layer having a constant thickness. A wall of the developer container 11*a* remote from the photosensitive drum 10 is provided with an opening 11*c* which communicates with an unshown opening of a toner container 110 for containing the toner, so that the developer container 11*a* and the toner container 110 communicate with each other.

When the toner in the toner container 110 is used up, the process cartridge has to be replaced. The service life of the process cartridge has to be changed in accordance with the types of the image forming apparatus with which the process cartridge is used. For example, in the case of a high speed copying machine, for example, the number of produced copies in a month is large, and therefore, the frequency of the process cartridge replacements is high. Therefore, it is desirable that the process cartridge has a larger capacity toner container to increase the service life thereof. On the other hand, in the case of a small capacity copying machine, the number of copies produced in a month is small. In addition, the reduction of the weight and the size of the main assembly of the image forming apparatus is desired. To meet this desire, the size of the process cartridge is reduced with the reduction of the toner capacity. Thus, different process cartridges are to be prepared for different main assemblies of the image forming apparatus.

SUMMARY OF THE INVENTION

Accordingly, it is a principal object of the present invention to provide a process cartridge and an image forming apparatus usable therewith in which when a process cartridge is manufactured in a factory, the process cartridge may be easily assembled with a different service life.

It is another object of the present invention to provide a process cartridge and an image forming apparatus usable with the process cartridge in which the process cartridge can be easily assembled.

It is a further object of the present invention to provide a process cartridge and an image forming apparatus usable with the process cartridge in which the process cartridge is easily disassembled.

It is a further object of the present invention to provide a process cartridge and an image forming apparatus usable with the process cartridge in which the process cartridge can be easily assembled or disassembled, so that various parts are reusable, by which environmental contamination can be reduced.

According to one aspect, the invention relates to a process cartridge detachably mountable to an image forming apparatus including a first frame having an electrophotographic photosensitive drum, a developing roller for developing a latent image formed on the photosensitive drum with a developer, and a cleaning blade disposed in contact with the photosensitive drum for removing residual developer from the photosensitive drum; and a second frame, separably engageable with the first frame, and including a developer accommodating portion for accommodating a developer for developing a latent image formed on the photosensitive drum by the developing roller and an exposure opening for permitting the photosensitive drum to be exposed to light from a main assembly of the image forming apparatus when the process cartridge is mounted to a main assembly of the image forming apparatus, the developer accommodating portion being provided with a developer supply opening, which is sealed by a removable seal, wherein developer in the developer accommodating portion is supplied to the developer roller from the developer accommodating portion by removing the removable seal; wherein the first frame and the second frame are separably engageable to constitute the process cartridge, and wherein the first frame and the second frame are separably engageable by elastic engagement means including a plurality of engaging members provided on the second frame and a plurality of respective engagement openings provided in the first frame.

The invention in another aspect pertains to a removable frame for a process cartridge detachably mountable to an image forming apparatus, the removable frame being separably engageable with a process frame to constitute a process cartridge, the process frame having an electrophotographic photosensitive drum, a developing roller for developing a latent image formed on the photosensitive drum with a developer, a cleaning blade for removing residual developer from the photosensitive drum, and an engagement opening, the removable frame including a developer accommodating portion for accommodating developer to be used by the developing roller; an elongated exposure opening for permitting the photosensitive drum to be exposed to light from a main assembly of the image forming apparatus, when the process cartridge is mounted to a main assembly of the image forming apparatus; an engaging member for elastically engaging the engagement opening of the process frame, for separable engagement therebetween, wherein the engaging member includes a plurality of hook portions arranged on a bottom surface of the developer accommodating portion; and a sealing member mounting portion for mounting a sealing member disposed at an engaging portion between the process frame and the removable frame, for preventing leakage of developer between the process frame and the removable frame when the process frame and the removable frame are engaged.

The invention in yet another aspect pertains to a process frame for a process cartridge detachably mountable to an image forming apparatus, the process frame being separably engageable with a removable frame to constitute a process cartridge, the removable frame having a developer accommodating portion for accommodating a developer for developing a latent image formed on a photosensitive drum, an elongated exposure opening for permitting the photosensitive drum to be exposed to light from a main assembly of the image forming apparatus when the process cartridge is mounted to the main assembly of the image forming apparatus, and an engagement member, the process frame including a drum mounting portion for mounting a photosensitive drum; a roller mounting portion for mounting a developing roller for developing a latent image on the photosensitive drum; a magnet mounting portion for mounting a magnet in the developing roller; a blade mounting portion for mounting a cleaning blade for removing residual developer from the photosensitive drum; and a plurality of engagement openings elastically engageable with an engaging member of the process frame, for elastic engagement between the process frame and the removable frame, the plurality of engagement openings roller from the developer accommodating portion by removing the removable seal; wherein the first frame and the second frame are separably engageable to constitute the process cartridge, and wherein the first frame and the second frame are separably engageable by elastic engagement means including a plurality of engaging members provided on the second frame and a plurality of respective engagement openings provided in the first frame. A method of assembling the process cartridge and the process frame are also envisioned.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 9 is a perspective view of the process cartridge when liquid elastomer is injected to a joint in a cartridge frame.

FIG. 10 is a perspective view of a cartridge after liquid elastomer is injected to the joint surface of the toner container.

FIG. 11 is a sectional view after the liquid elastomer is injected.

DETAILED DESCRIPTION OF THE PREFERRED EMBODIMENTS

Referring to the accompanying drawings, the embodiments of the present invention will be described.

Figure 3:
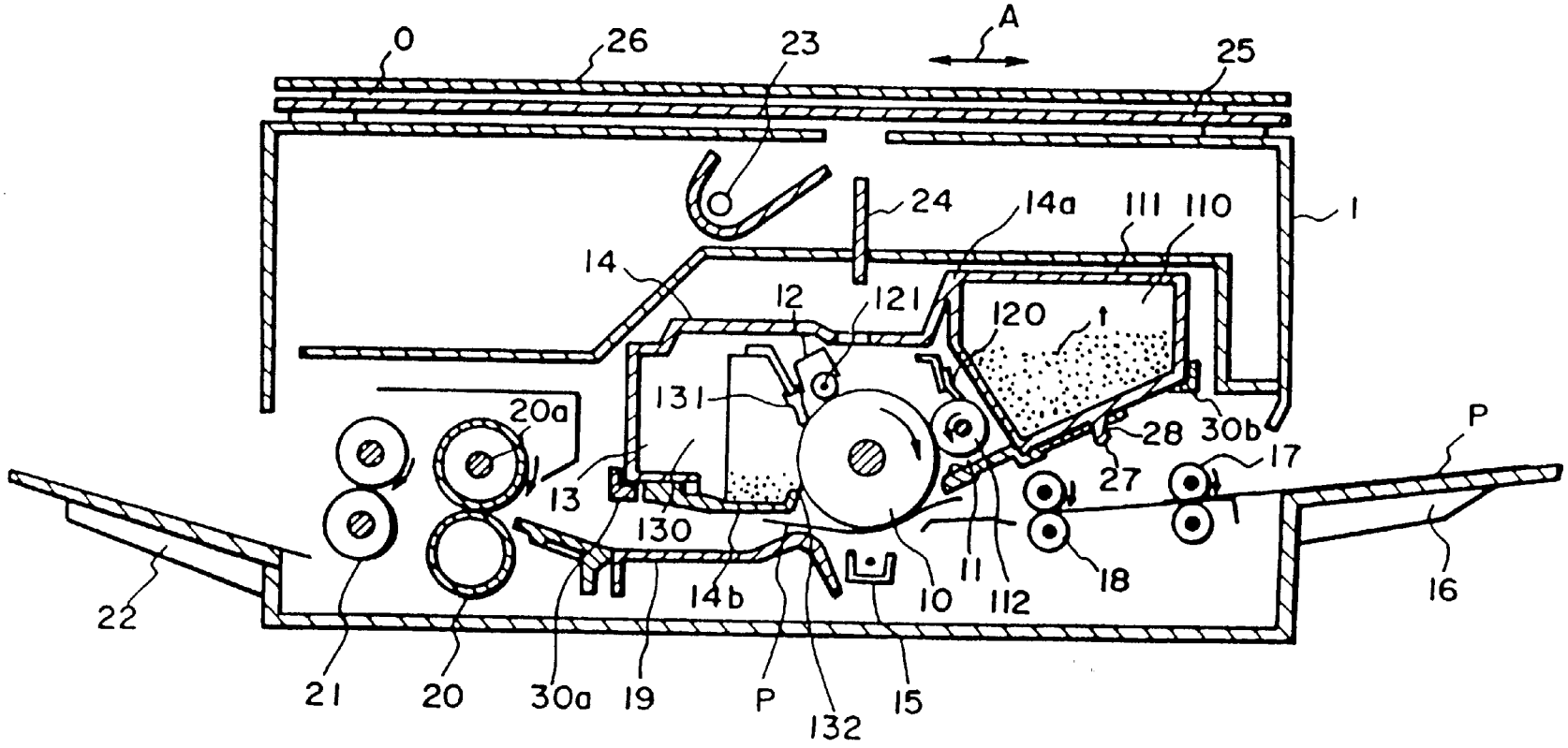
FIG. 3 is a sectional view of an image forming apparatus to which the process cartridge according to the present invention is detachably mountable.

Referring to FIG. 3, there is shown an image forming apparatus usable with a process cartridge according to an embodiment of the present invention. Designated by a reference numeral 10 is an image bearing member in the form of a photosensitive drum, for example. Around the photosensitive drum 10, there are disposed image formation process means such as a developing device 11, a charger 12 or a cleaning device 13. The photosensitive drum 10 and such process means are constituted into a unit on process cartridge frames 14*a* and 14*b* of plastic material. The process cartridge 14 thus constituted is detachably mountable to the main assembly 1 of the apparatus. Thus, the maintenance or servicing operation is made easier. The structure of the process cartridge casing will be described in detail hereinafter. When the process cartridge 14 is mounted in the main assembly, a transfer charger 15 is below the photosensitive drum 10. At the sheet supply side of the transfer charger 15, there are a sheet feeding tray 16, a pick-up roller 17 and registration rollers 18. On the other hand, at the sheet discharge side thereof, there are a sheet guide 19, an image fixing device 20, sheet discharging rollers 21 and a sheet discharge tray 22.

Above the process cartridge 14, there is disposed a short focus optical element array 24 for imaging on the photosensitive drum 10 the light which is emitted from an original illumination lamp 23 and is reflected by the original O. At the top of the main assembly 1, there is an original carriage 25 reciprocable in the directions A. Designated by a reference numeral 26 is an original cover.

The photosensitive drum 10 is uniformly charged by a charger and is exposed to the light from the original O through the optical element array 24, so that an electrostatic latent image is formed on the photosensitive drum 10 in accordance with the information of the original. The electrostatic latent image is carried by the rotation of the photosensitive drum 10 to the developing device 11 where the latent image is developed with toner t into a toner image. Then, the transfer sheet P is fed to the registration rollers 18 from the sheet tray 16 through the sheet feeding roller 17. Then, it is fed to between the photosensitive drum 10 and the transfer charger 15 in timed relation with the latent image by the registration roller 18. The toner image is transferred from the photosensitive drum 10 onto the transfer sheet P by the transfer charger 15. The transfer sheet P carrying the transferred toner image is fed to the fixing device 20 where the toner image is fixed into a permanent image. Then, the transfer sheet P is discharged onto the tray 22 by the discharging rollers 21. The photosensitive drum 10, after the completion of the image transfer, is cleaned by the cleaning device 13 for removing the residual toner, so that the photosensitive drum 1 is now prepared for the next image forming operation. Designated by reference numerals 30*a* and 30*b* are mounting means in the form of guides for facilitating mounting of the process cartridge 14 to the main assembly of the image forming apparatus.

Referring to FIGS. 1, 2A, 2B and 2C, the process cartridge 14 of this embodiment will be described in detail. The casing of the process cartridge 14 in this embodiment comprises upper casing A (14*a*) and a lower casing B (14*b*). The casings A and B can be joined or disjoined each other.

The casings A and B are of molded plastic material having elasticity. At the right side of the casing A, a toner container 110 functioning as the developer container is integrally formed. A plug 111 is fused to seal the container. The opening 111*a* of the toner container 110 which communicates with the developing device 11 is closed by a bonded sealing member 113, as shown in FIG. 2C. An end of the sealing member 113 is folded and is projected to the outside of the casing A. A grip 114 is connected to the end. When the operator pulls the grip 114, the sealing member 113 is removed from the opening 111*a* so as to permit supply of the toner t to the developing sleeve 112. Below the toner container 110, there is a pawl 27 for coupling the casings A and B. By the engagement between the pawl 27 integrally formed on the casing A and an opening formed in the casing B, the upper and lower casings A and B can be coupled with a simple structure. Four of such pawls 24 and corresponding openings 28 are arranged in a direction perpendicular to the sheet of the drawing. More particularly, the opening 28 is engaged by the pawl 27 at the inclined surface 27*a,* and an end 28*a* of the opening 28 is locked by the bottom surface 27*b* of the pawl 27. Since the pawl 27 has such an elasticity that the engagement with the opening 28 and the disengagement therefrom can be smoothly carried out and that the coupling by the opening 28 is assured. At the left side of the casing A, as shown in the FIG, 3 residual toner container 130 (developer container) 130 is formed. An end of the casing A is folded to form a part 14*a*1 of the bottom surface of the container 130. The bottom casing B is extended to the position overlapping with the bottom surface 14*a*1, where they are threaded at the overlapped portion by screws 29. Therefore, the bottom surface of the container 130 is constituted by the parts of the casings A and B. A part of the casing A faced to the upper part of the photosensitive drum 10, is provided with an opening 141 for permitting passage of light for the image exposure. Around the openings in the toner container and the cleaner container, there are sealing members 26*a* and 26*b* made of foamed polyurethane material to prevent leakage of the toner from the container.

Figure 2A:
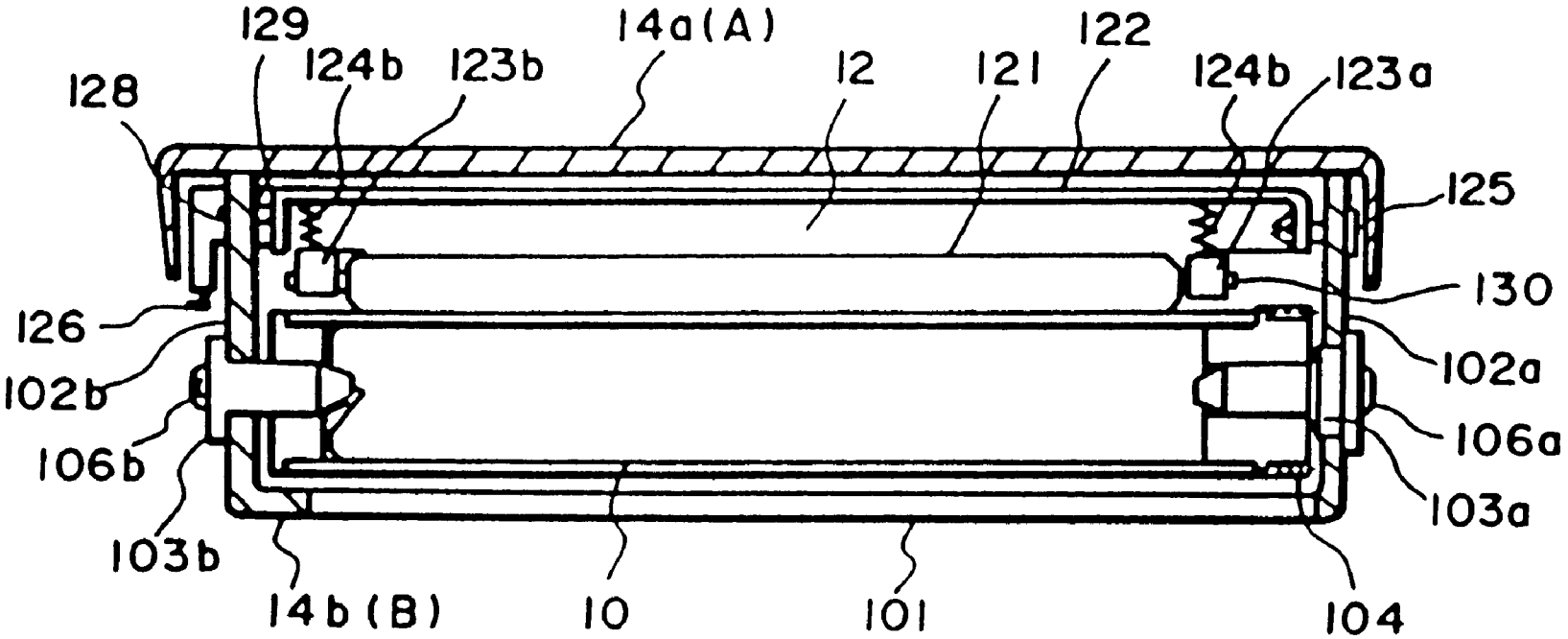
FIGS. 2A, 2B and 2C are sectional views taken along lines a—a, b—b and c—c, respectively, of FIG. 1.

As shown in FIG. 2A, the casing B covers the bottom part of the process cartridge 14, and from the side surface, walls 102*a* and 102*b* are raised and are extended to the bottom surface of the casing A. To the walls 102*a* and 102*b* of the casing B, supporting shafts 103*a* and 103*b* for rotatably supporting the photosensitive drum 10 are securedly mounted by screws 106*a* and 106*b* below the photosensitive drum 10, the casing B is provided with an opening 101 for permitting transfer of the toner image from the photosensitive drum 10 to the transfer sheet P and for receiving an unshown driving device of the main assembly of the image forming apparatus. Above the side wall 102*a* of the casing B, a charger case 122 is supported by a fixing pin 125. At the other end of the charger casing 122, a pin 128 is integrally formed and is engaged in and supported by a hole 129 formed in the side wall 102*b* of the casing B. In the charger casing 122, bearings 123*a* and 123*b,* which support a shaft 130 of the charging roller 121 while urging the charging roller 121 to the photosensitive drum 10. An end of the charger case 122 extends to the outside of the casing B and contains electrode plate 126 for supplying electric power to the charging roller 121. The electrode plates 126 are connectable with power supply contacts (not shown) of the main assembly of the image forming apparatus.

Figure 1:
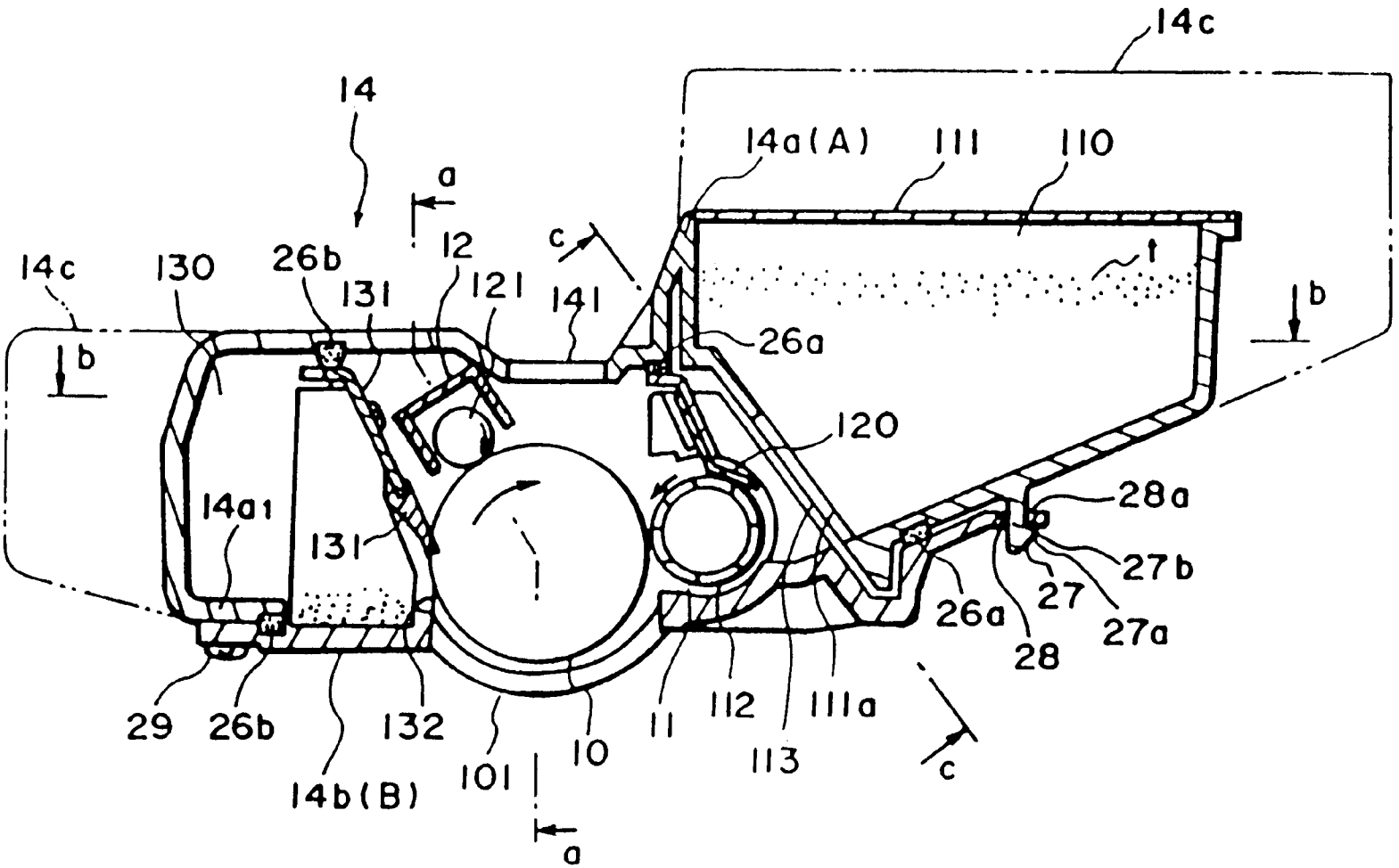
FIG. 1 is a sectional view of a process cartridge according to an embodiment of the present invention.
Figure 2B:
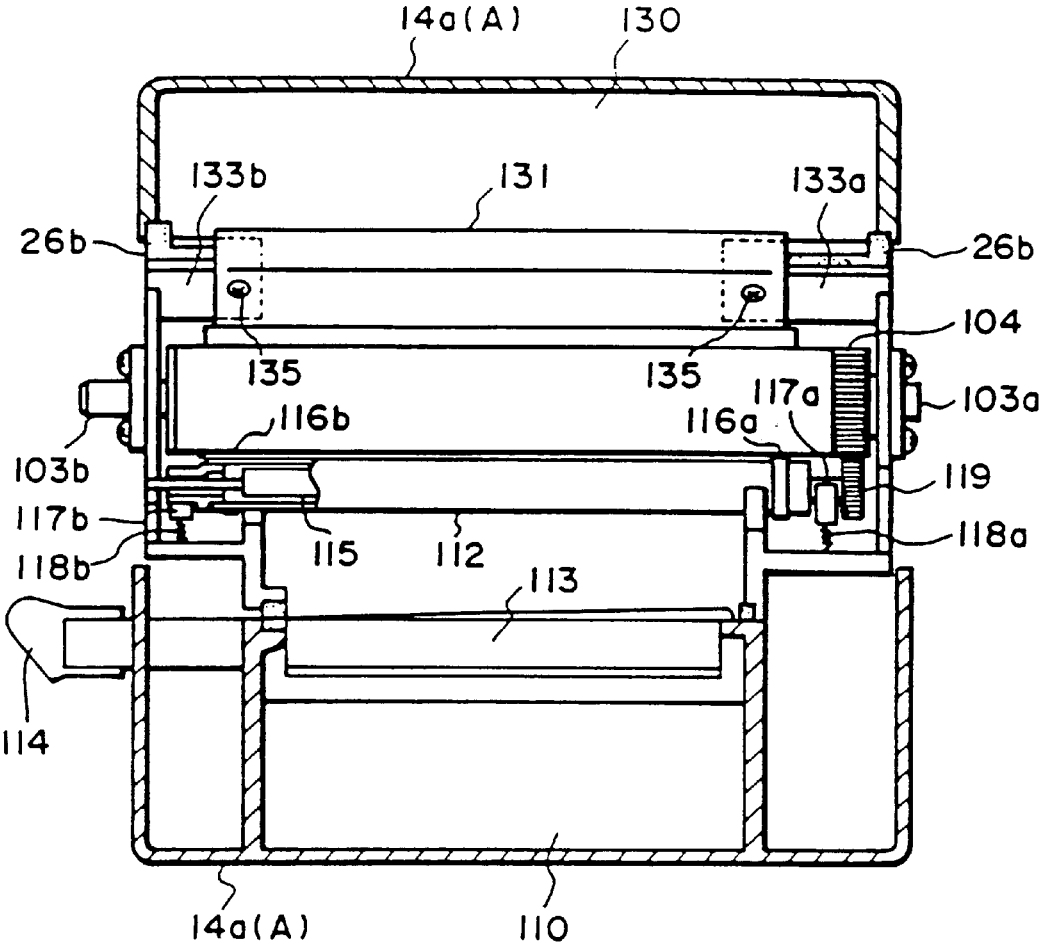
Figure 2C:
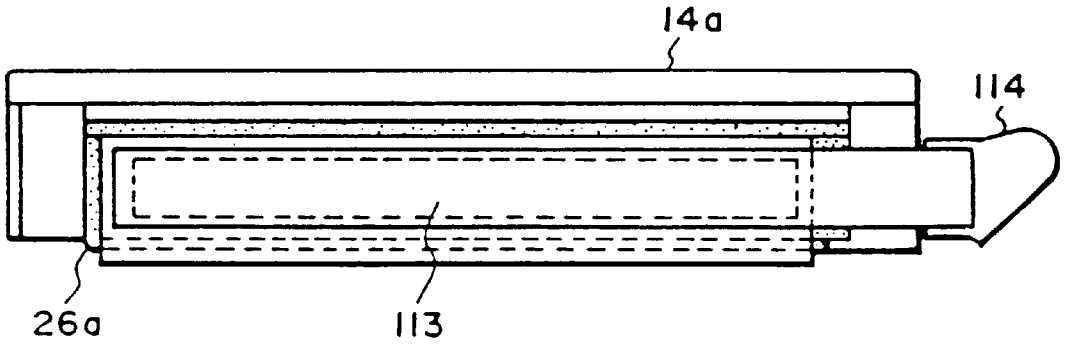

Referring to FIGS. 1 and 2B, the cleaning device 13 and the developing device 12 will be described in detail. The casing B is provided with seats 133*a* and 133*b* for mounting the cleaning blade 131 for contacting to the photosensitive drum 10 to scrape the residual toner off the peripheral surface of the photosensitive drum 10. The cleaning blade 131 is fixedly mounted on the seats 133*a* and 133*b* by screws 135. Adjacent a longitudinal end of the opening 101 formed at the lower side of the casing B, a receiving sheet 132 is bonded. The side wall of the casing B is bent toward inside adjacent the toner container 110. The bent portion functions to support through springs 118*a* and 118*b* sleeve bearings 117*a* and 117*b* for supporting the developing sleeve 112. The developing sleeve 112 has spacers 116*a* and 116*b* for maintaining a constant clearance between the surface of the developing sleeve 112 and the photosensitive drum 10. The spacers 116*a* and 116*b* are urged to the photosensitive drum by the springs 118*a* and 118*b*. To one of the ends of the developing sleeve 112, a gear 119 is mounted which meshes with a drum gear 104 mounted to the drum 10. With the rotation of the photosensitive drum 10, the gear 119, and therefore, the developing sleeve 112 is rotated in the direction indicated by an arrow in FIG. 1. In the developing sleeve 112, a cylindrical magnet roller 115 is disposed. It is provided with plural magnetic poles. The end pins thereof are supported by the casing B. Above the developing sleeve 112, a blade 120 is mounted on an unshown seat projected from the side walls 102*a* and 102*b* of the casing B.

The lower casing B contains the photosensitive drum 10, the cleaning blade 131, the receiving sheet 132, the charger 12, the developing sleeve 112 and the blade 120 for the developing sleeve 112. Therefore, the positional accuracies of various elements relative to the photosensitive drum 10 are assured by the accuracy of the casing B, and therefore, the correct positioning are made easier.

In addition, the process cartridge 14 of this embodiment can be disassembled into the upper casing A and the lower casing B. The process cartridges 14 from which the toner has been used up, are collected. The collected cartridge 14 is disassembled into the casings A and B. Then, the casing A is cleaned, and a fresh sealing member 113 is bonded. An unshown toner cap is removed from a filling opening, and the toner is supplied through the opening. Thereafter, the opening is plugged by the toner cap, again. In addition, worn parts and creeped rubber elements or the like which are not reusable, are replaced with new ones. Then, the casings are joined together. The process cartridge 14 is now distributed from the factory.

Casing B containing the process means may be joined with another casing 14c which has the shape as shown in FIG. 1 and which has a larger toner capacity and a larger residual toner capacity than those of the casing B. Then, another process cartridge having a longer service life and usable with a different type main assembly, can be easily manufactured.

Figure 4:
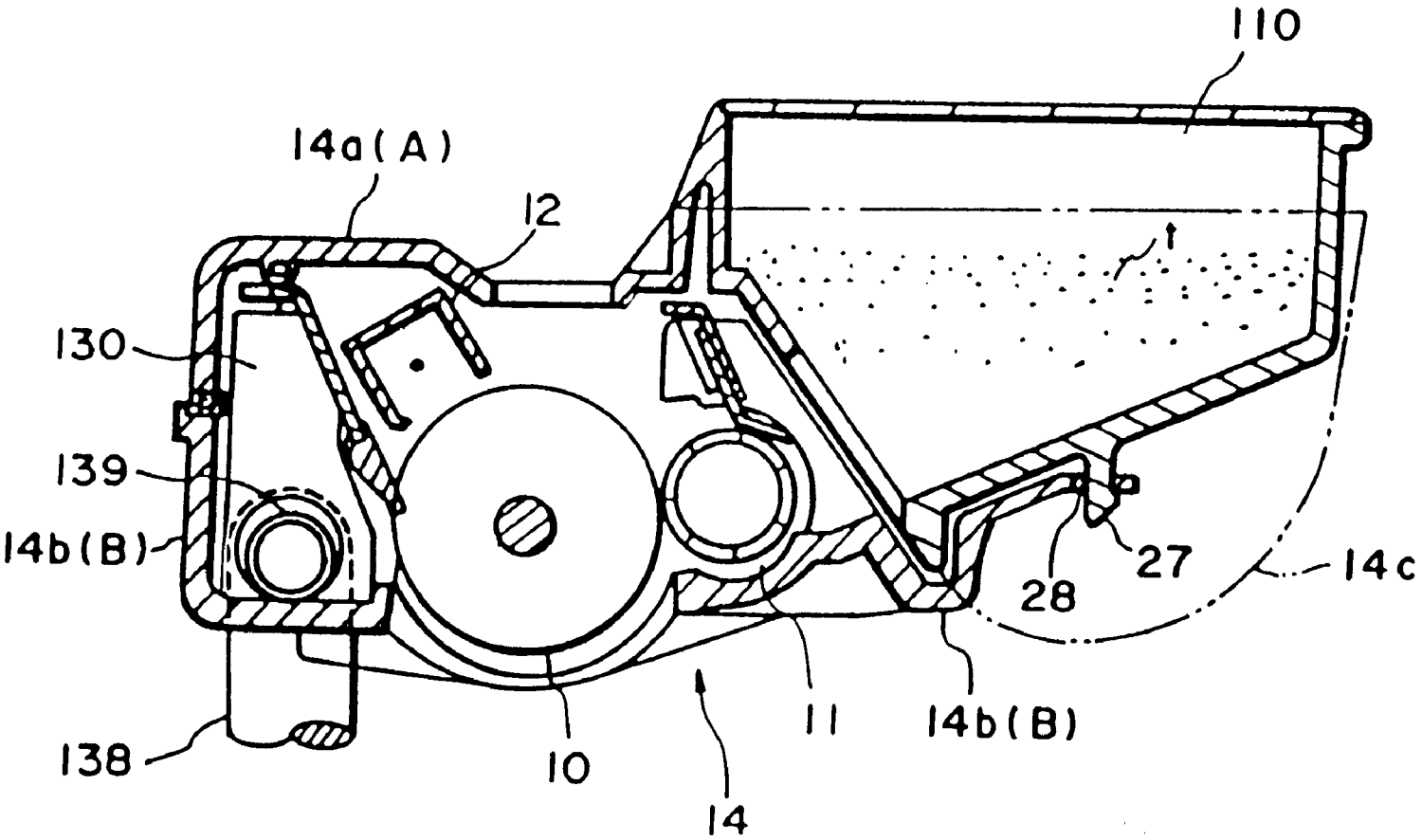
FIG. 4 is a sectional view of a process cartridge according to another embodiment of the present invention.

FIG. 4 shows a process cartridge according to another embodiment of the present invention. A pipe 138 is provided for permitting discharge of the residual toner from the process cartridge 14. The pipe is connected to an unshown residual toner bottle (not shown) in the main assembly of the image forming apparatus. The residual toner container 113 is provided therein with a helical residual toner conveyer 139 for supplying the residual toner to the discharge pipe 138. An end of the residual toner conveyer 139 is coupled with a driving gear (not shown). The driving gear is meshed with the drum gear 104. In this example, it will suffice if the upper casing A is provided only with the toner container 110. The residual toner container is not necessary. Then, it is not necessary that the residual toner capacity is dependent on the toner capacity. In this embodiment, the residual toner container is formed by the coupling between the casing A and the casing B.

A phantom line 14*c* illustrates a configuration of another example of the casing A. In the case of the casing 14*c*, the toner container 110 is disposed at a lower side. The toner container 110 is provided therein with toner conveyer means (not shown). To both sides of the toner container 110, the casing B is extended and is engaged with coupling pawl 27 formed on the ends of the toner container 110 of the casing A.

In the foregoing embodiments, the process cartridge has the developing means. However, the present invention is applicable to the process cartridge not having the developing means. In this case, the present invention is applied to the residual toner container for the cleaning means.

Figure 5:
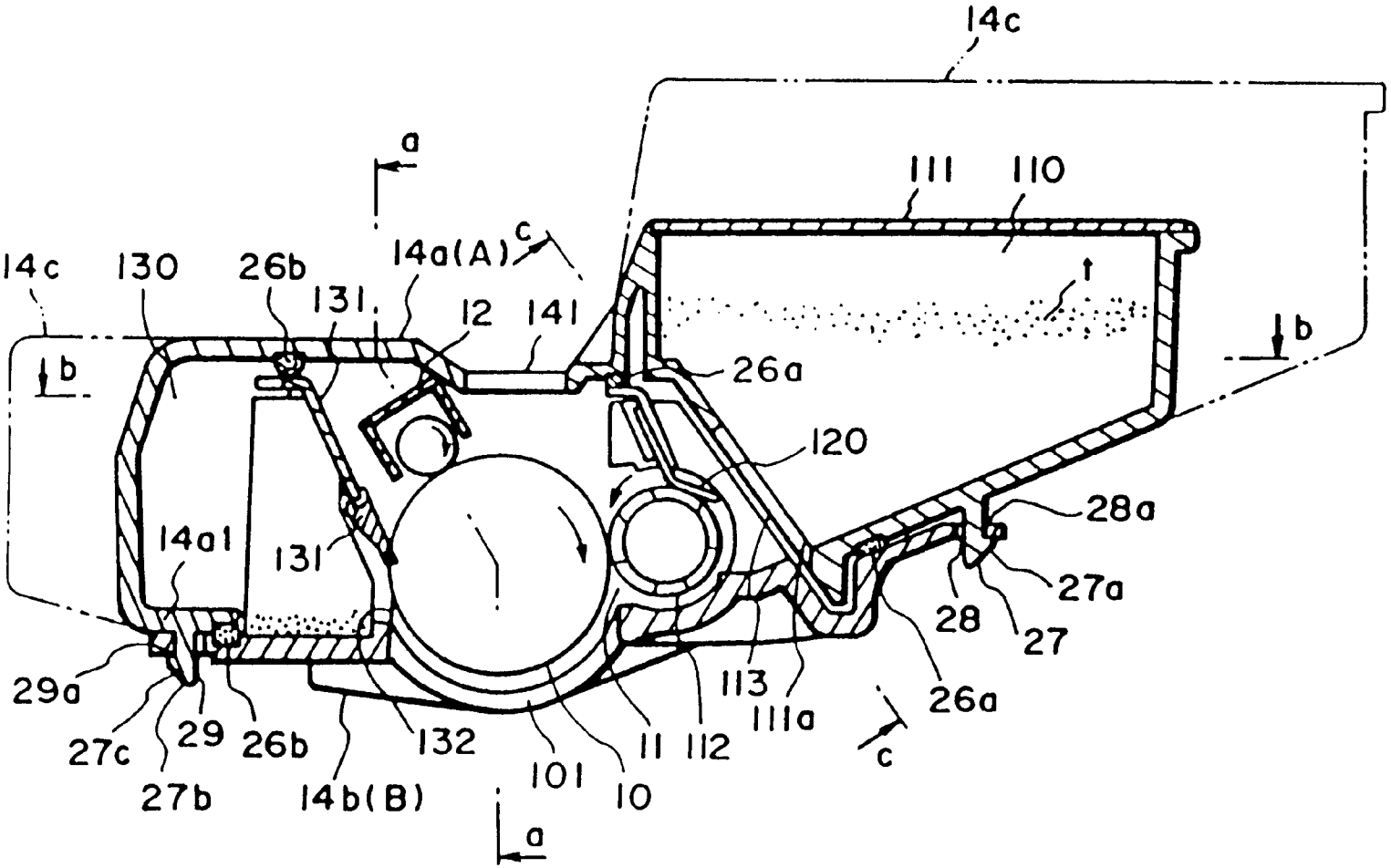
FIG. 5 is a sectional view of a process cartridge according to a further embodiment of the present invention.
Figure 6A:
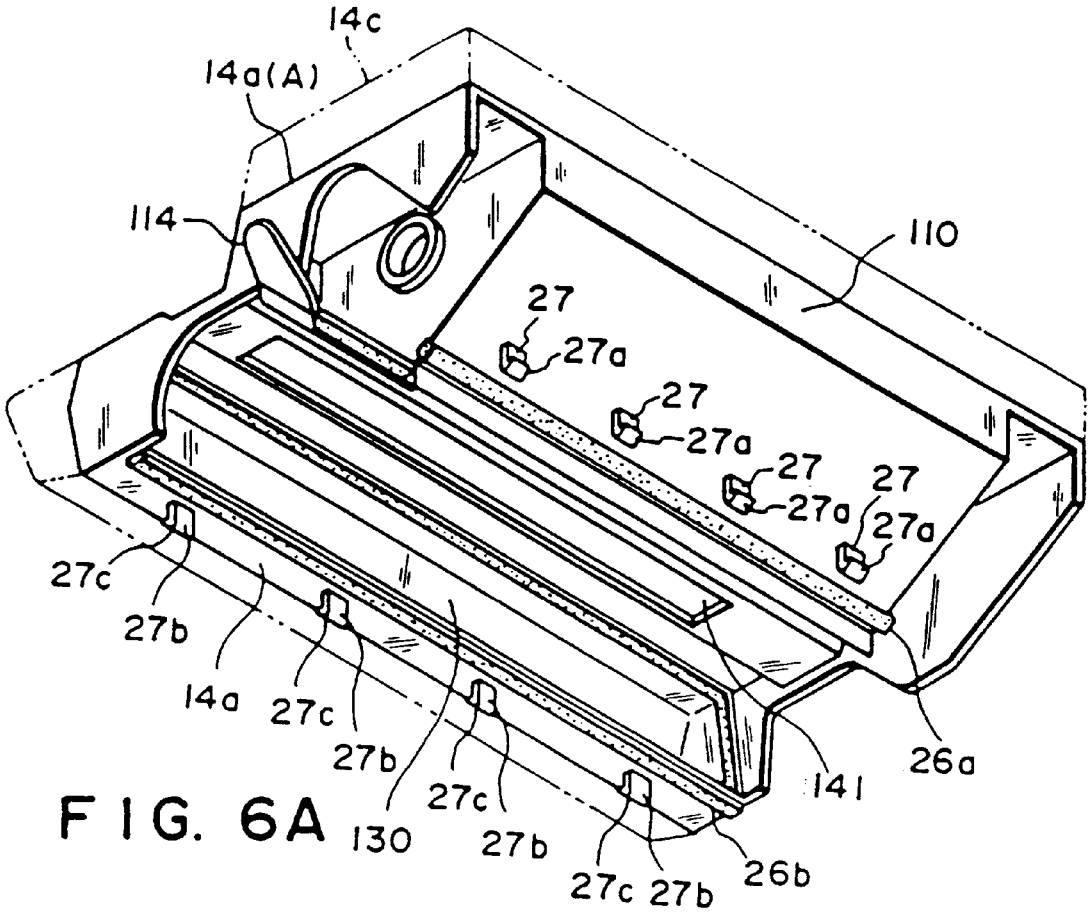
FIG. 6A is a perspective view of an upper body.
Figure 6B:
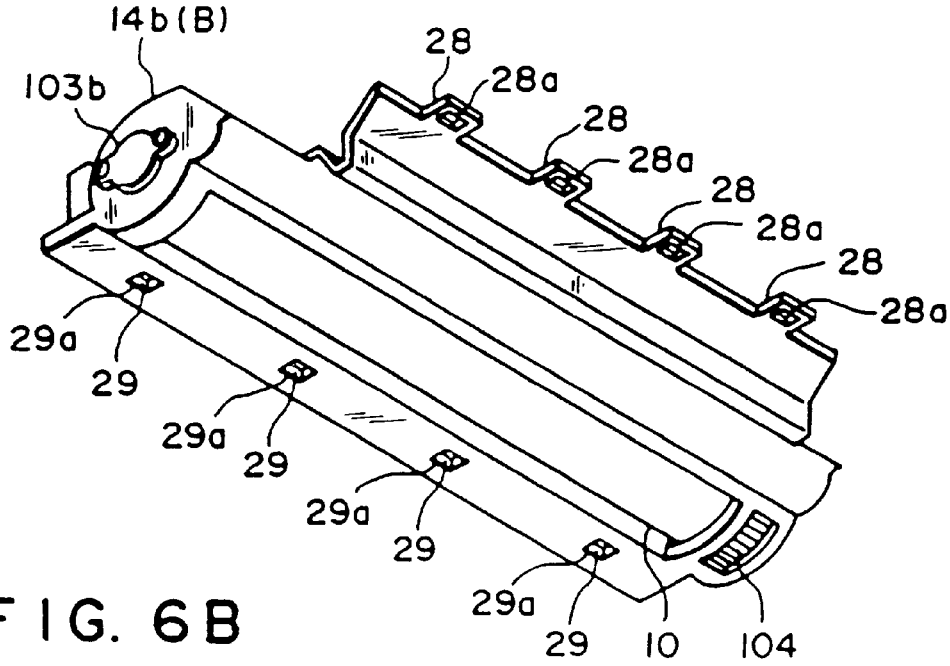
FIG. 6B is a perspective view of a bottom body.
Figure 7:
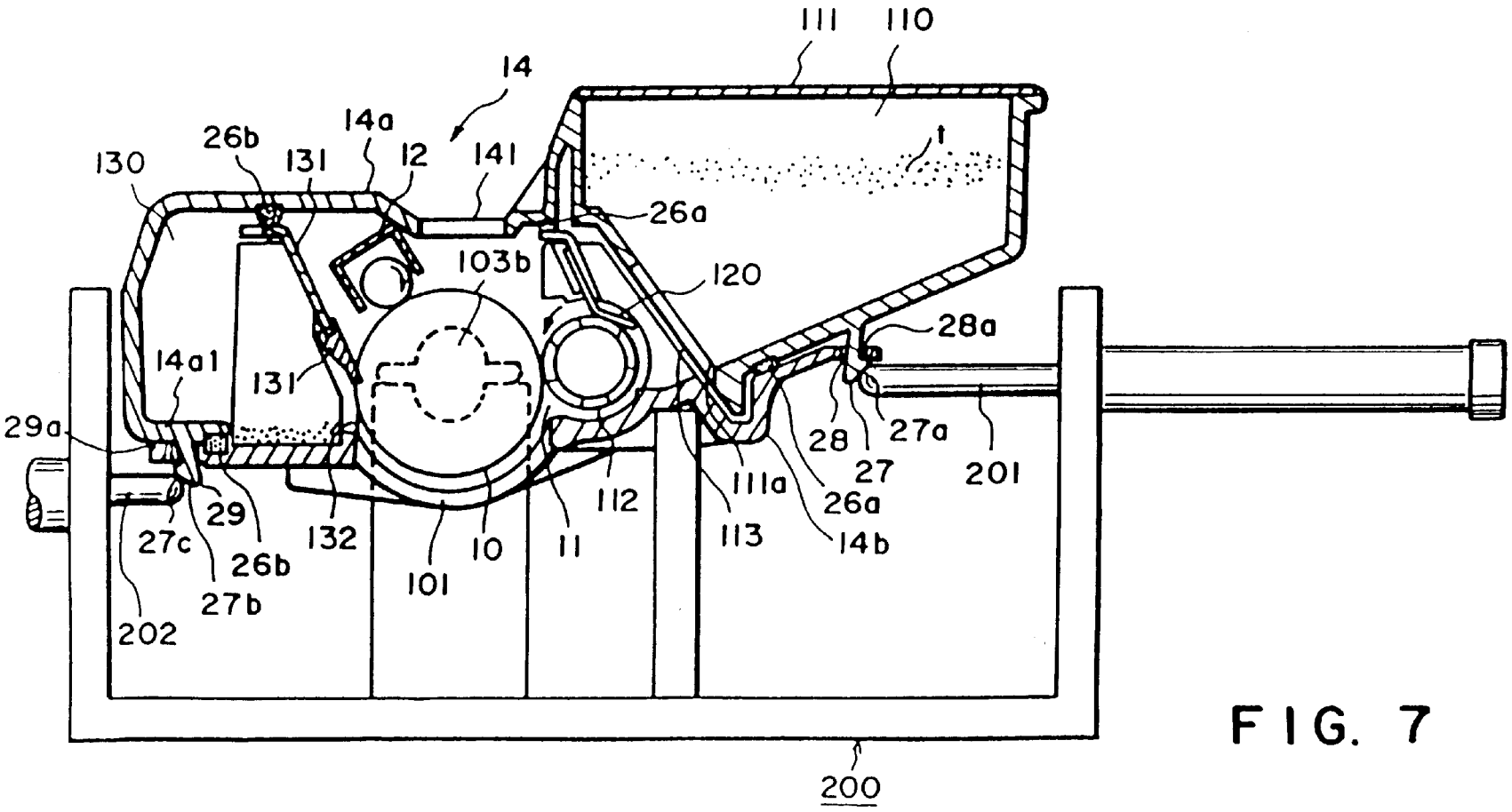
FIG. 7 illustrates disassembling of the process cartridge.

Referring to FIGS. 5, 6A and 6B, a further embodiment of the present invention will be described. FIG. 5 is a side sectional view of a process cartridge according to this embodiment, FIG. 6A is a perspective view of an upper casing, and FIG. 6B is a perspective view of a lower casing.

In the foregoing embodiments, the upper and lower casings A and B are joined not only by the engagement between pawls and openings but also screws. In the present embodiment, however, the casings A and B can be joined only by engagement between pawls and openings. In the description of this embodiment, the same reference numerals as in the foregoing embodiments are assigned to the elements having the corresponding functions, and the detailed description thereof are omitted for simplicity.

Sectional views taken along lines a—a, b—b and c—c in FIG. 5 are as shown in FIGS. 2A, 2B and 2C, respectively, which have been described hereinbefore. The process cartridge of this embodiment is also detachably mountable to the main assembly of the image forming apparatus, as shown in FIG. 3.

In this embodiment, the casing A and the casing B are securedly joined by engagement between pawls 27*b* and the openings 29 in place of the screws 29 in the above-described embodiment. In the present embodiment, four pawl 27*b* are formed on the bottom outside surface 14*a*1 of the residual toner container 130 formed at the left side of the casing A. Correspondingly, the casing B is provided with four openings 29 in the wall overlapped with the bottom surface 14*a*1 of the casing A. Similarly to the toner container 110 side, the pawls 27*b* of the casing A and the openings 29 of the casing B are engaged with each other at the residual toner container 130 side, so that the casings A and B are joined together. Designated by a reference 27*c* is in inclined surface of the pawl 27*b*, and 29 is an engaging end of the opening 29. In this embodiment, the pawls 27 at the toner container 110 side and the pawls 27*b* at the residual toner container 130 side are inclined outwardly, in other words, they are inclined away from each other. By doing so, the elasticity of the casings A and B of plastic material, more particularly, the elasticity of the pawls 27 and 20*b* cooperates to enhance the fastening engagement when they are engaged with the associated openings 28 and 29.

In this embodiment, the process cartridge can be easily disjoined. As described above, the upper and lower casings A and B are joined by the pawls 27 and 27*b*. When the process cartridge is to be disjoined, the process cartridge 14 is put on a disjoining device 200. Then, rods 201 and 202 are pushed to push the pawls 27 and 27*b*. Thus, the upper casing A can be easily disjoined from the lower casing B.

Without use of the device 200, the casings A and B can be disjoined from each other by properly pushing the pawls 27 and 27*b*. However, in this case, it is preferable to push the plural pawls simultaneously, and therefore, it is easier if the device 200 is used.

A further embodiment of the process cartridge will be described. In this embodiment, additional sealing members are employed to further prevent the leakage of the developer to the outside of the cartridge.

Figure 8:
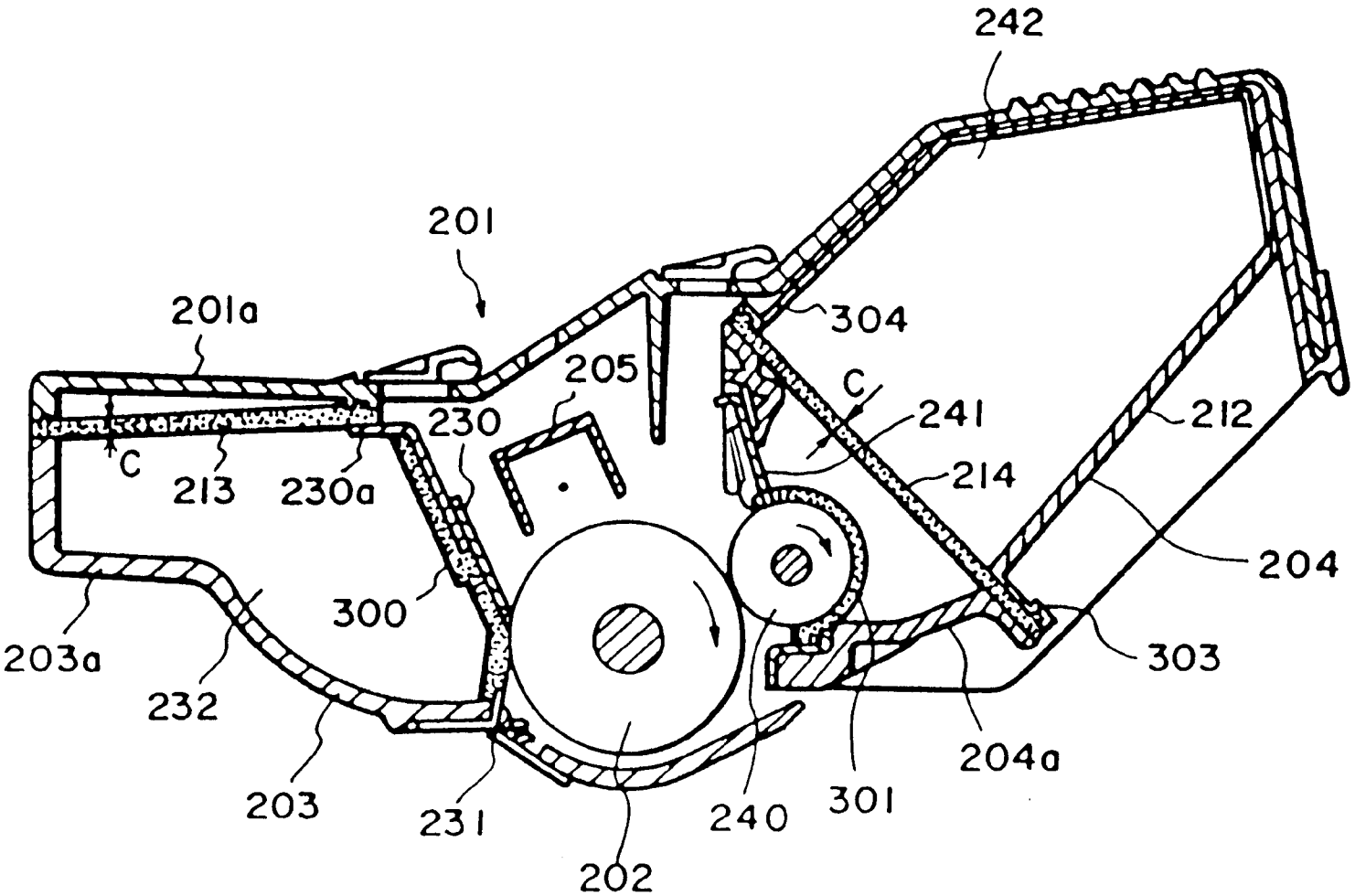
FIG. 8 is a sectional view of a process cartridge to which the present invention is applicable.

Referring to FIGS. 8, 9, 10 and 11, the description will be made as to the cartridge of this embodiment having the sealing members. FIG. 8 is a sectional view of the process cartridge according to this embodiment. The process cartridge 201 contains an image bearing member in the form of a photosensitive drum 202 and process means disposed therearound, the process means include a cleaning device 203, a developing device 204 and a charger 205 supported on a cartridge frame 201*a*. They constitute a unit which is detachably mountable to a main assembly of the image forming apparatus, as a unit. When the photosensitive drum 202 and/or the developing device 204 comes to an end of the service life, when the cleaning device 203 is filled with the residual toner or when the toner in the developing device 204 is used up, the entirety of the process cartridge 201 is replaced with a new process cartridge. Thus, the maintenance or servicing operations are easy. In this embodiment, the charger 205 is in the form of a well-known corona charger, but it may be replaced with a contact type charger as disclosed in U.S. Pat. No. 4,851,960.

The cleaning device 203 comprises a cleaning blade 230 for removing the residual toner (residual developer) from the surface of the photosensitive drum 202, a toner receiving sheet 231 for preventing leakage of the residual toner to an outside, and a residual toner container 232 for containing the residual toner. The residual toner container 232 is constituted by connecting through sealing members 213 the cleaning container 203*a,* the blade holder 230*a* and the cartridge frame 201*a*. The sealing members 213 are effective to prevent leakage of the toner through the joint portions.

The developing device 204 comprises a developing sleeve 240 rotatable in a constant direction and effective to supply the toner (developer) from its outer periphery to the photosensitive drum 202, a regulating blade 241 for regulating a thickness of a layer of the developer on the developing sleeve 240, and a toner container 242 for containing the toner and for supplying the developer to the developing sleeve 240. The toner container 242 is constituted by the toner container 212 and the developer container 204 which are coupled by screws or the like with a sealing member 214 therebetween so that they can be disjoined and cleaned. The sealing member 214 is effective to prevent leakage of the toner through the joint portion.

In the process cartridge having the structure described above, the photosensitive drum 202 is uniformly charged by a charger 205 and is exposed to image light, so that an electrostatic latent image is formed on the photosensitive drum 202. With the rotation of the photosensitive drum 202, the electrostatic latent image reaches the developing device 204, where the latent image is supplied with the toner from the developing sleeve 240 of the developing device 204 so as to be developed into a toner image. The toner image is transferred onto the transfer sheet through an unshown transfer charger or the like. After the completion of the image transfer action, the photosensitive drum 202 is cleaned by the cleaning blade 230 so that the residual toner is removed from the photosensitive drum 202. Then, the photosensitive drum 202 is prepared for the next image forming operation. The residual toner removed by the cleaning blade 230 is collected into the residual toner container 232 of the cleaning device 203 by way of the receiving sheet 231 contacted to the photosensitive drum 202.

Referring to FIGS. 9 and 10, the description will be further made as to the sealing members 213 and 214. The sealing members of this embodiment are provided by injecting from a nozzle 215 two-liquid urethane rubber material R to a coupling surface 201*b* (FIG. 9) of the cartridge frame 201*a* and to a coupling surface 212*a* (FIG. 10) of the toner container 212. The material R is a foaming material, and therefore, it is foamed and solidified into elastomer on the coupling surfaces 201*b* and 212*a* approximately 20 sec.–10 min. after the injection.

In FIG. 9, the material R extends from point (a) along arrows 216 and 217 and returns to the point (a), thus constituting a closed loop. As regards the sealing member 214 shown in FIG. 10, the injection starts at point (b) and proceeds along the direction of arrows 218 and 219 *a* and returns to the original point (b). The coupling surfaces 201*b* and 212*a* are provided beforehand with grooves 211 as shown in FIG. 11. Therefore, the material R ultimately becoming the sealing member flows into the groove and then is solidified into an elastic elastomer. Therefore, the sealing member is not easily removed or easily deviated.

With the solidified sealing members 213 and 214 on the cartridge frame 210*a* and the toner container 212, the cartridge frame 201*a* and the toner container 212 are coupled with the cleaning container 203*a* and the developing container 204*a,* respectively, by which the toner leakage through the connecting portions can be properly prevented. The height h (FIG. 11) of the elastomer members 213 and 214, after solidification, is larger than the clearance C (FIG. 8) after the containers are coupled, and therefore, the sealing members are pressed down to the height which is equal to the clearance C, thus filling the clearance.

In this embodiment, the material R injection or dispensing from the injection nozzle, the injection speed, the injection rate, can be completely automatically controlled, so that the sealing members can be formed along the connecting surface with certainty. Therefore, the system conveniently meets the complicated shape as shown in FIG. 9.

In the foregoing description, the foaming polyurethane rubber is used as the sealing member material R. However, the material is not limited to this, and another material such as soft rubber or plastic material such as silicone rubber or another elastomer (elastic high polymer material) may be used with the same advantageous effects.

Thus, the sealing members are provided by solidifying liquid elastomer such as foaming polyurethane rubber or the like to seal the coupling portion of plural members such as the developing device 204 in the process cartridge, the toner container of the cleaning device 203 and the residual toner container. Therefore, the toner seal can be easily accomplished in the coupling portions of the containers having complicated structure. In addition, the closed loop can be easily formed, and therefore, the toner leakage through a sealing member connecting portion can be prevented.

Figure 12:
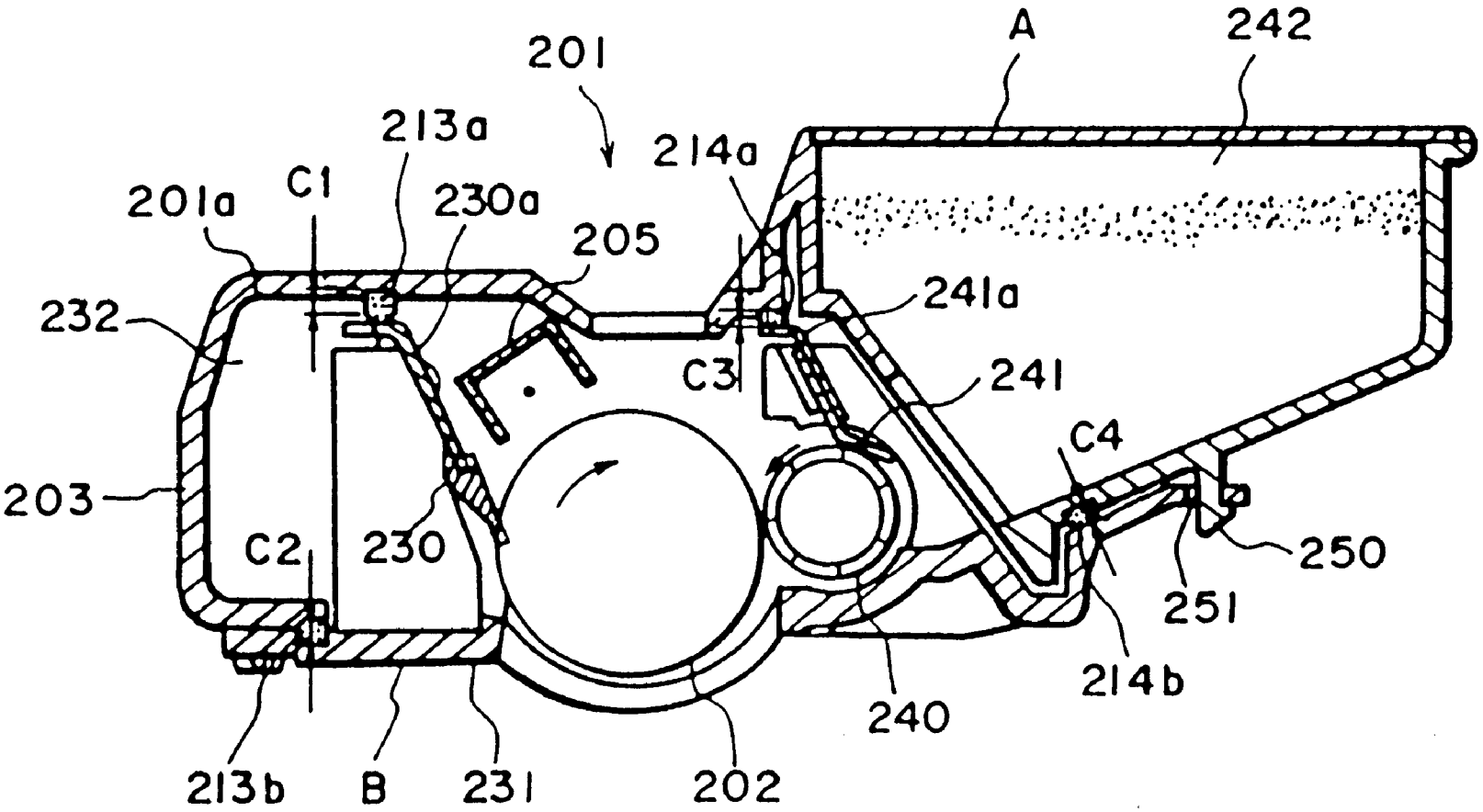
FIG. 12 is a sectional view of a process cartridge according to an embodiment of the present invention.
Figure 13:
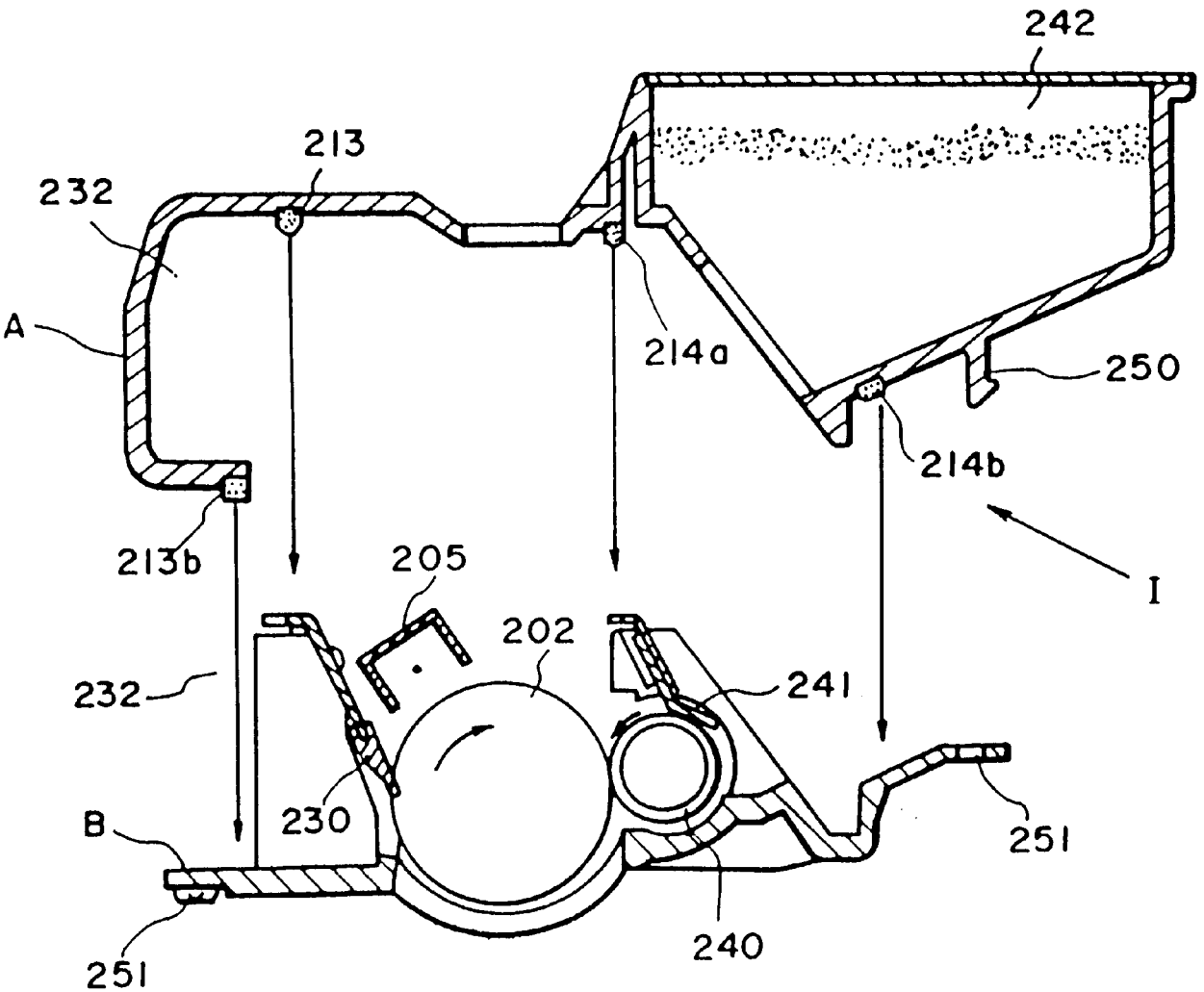
FIG. 13 is a sectional view when the process cartridge is divided into an upper body and a lower body.
Figure 14:
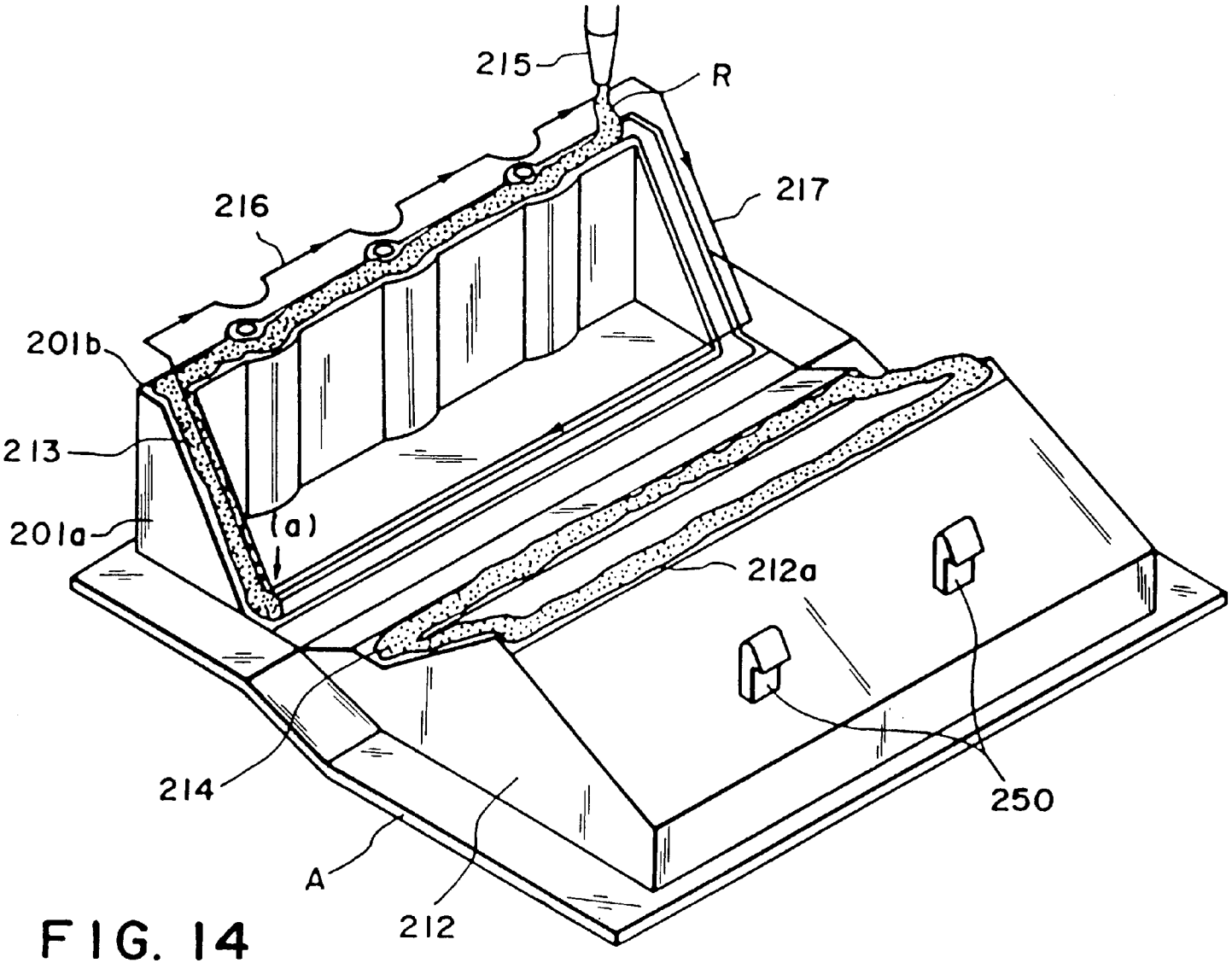
FIG. 14 is a perspective view when liquid elastomer is injected to the joint of the upper body.

Referring to FIGS. 12, 13 and 14, there is shown a process cartridge according to a further embodiment of the present invention. As shown in FIG. 12, the process cartridge is constituted by an upper frame A and a lower frame B in this Figure, the same reference numerals as in FIG. 8 are added to the elements having the corresponding functions.

As shown in FIG. 13, the process cartridge of FIG. 12 has the upper and lower frames A and B which are coupled by pawls 250 and screws 251. The pawls 250 of the upper frame A are elastically engaged with associated openings 251 formed in the lower frame B, by which the upper frame A and the lower frame B are coupled. The upper and lower frames A and B sandwich sealing members 213*b* and 214*b*. The toner container 242 is constituted by coupling the upper and lower frames A and B and by coupling the upper frame A and a blade holder 241*a* for supporting a regulating blade 241. The coupling portions are provided with a sealing member 214*a* to prevent leakage of the toner. The residual toner container 232 of the cleaning device 203 is constituted by coupling the upper and lower frames A and B and by coupling the upper frame A and a cleaning holder 230*a* for supporting a cleaning blade 230. The coupling portion is provided with a sealing member 213*a* to prevent the toner leakage.

FIG. 14 shows the view in the direction I in FIG. 13. In this embodiment, as shown in FIG. 14, the two-liquid urethane rubber material R is dispensed from the nozzle 215 to the coupling surfaces between the upper and lower frame portions of the toner container and the residual toner container. Since the material is of foaming nature, it foams and becomes elastomer on the coupling surfaces 201*b* and 212*a* in approximately 30 sec.–10 min. after injection or dispense. The injection path starts at (a) and extends in the directions of arrows 216 and 217 to return the position (a), so that a closed loop is formed. The surfaces receiving the material R (coupling surfaces 201*b* and 212*a*) are formed into grooves beforehand, and therefore, the material R easily flows into the grooves, and then solidified into an elastomer. Therefore, the sealing member is not easily removed or deviated. In this manner, with the solidified sealing members 213 and 214 on the upper frame A, it is coupled with the lower frame B, so that the sealing members 213 and 214 function to prevent leakage of the toner from the toner container and from the residual toner container. The height h (FIG. 11) of the sealing members 213 and 214, after solidification, is higher than the clearances C1, C2, C3 and C4 (FIG. 12) after the frames are coupled, and therefore, the elastomer is pressed to the heights equal to the clearances C1–C4, thus filling the clearances.

Similarly to the foregoing embodiment, in the present embodiment, the injecting path, speed and rate can be completely automatically controlled, so that the sealing member can be provided along the coupling surfaces with certainty. In addition, the injecting portions are concentrated on one of the frames, and therefore, the injecting or dispensing operation can be completed after only one positioning of the frames. This is advantageous in that the number of manufacturing steps can be significantly reduced.

Similarly to the foregoing embodiment, the material R may be soft rubber of soft plastic or the like.

Figure 15:
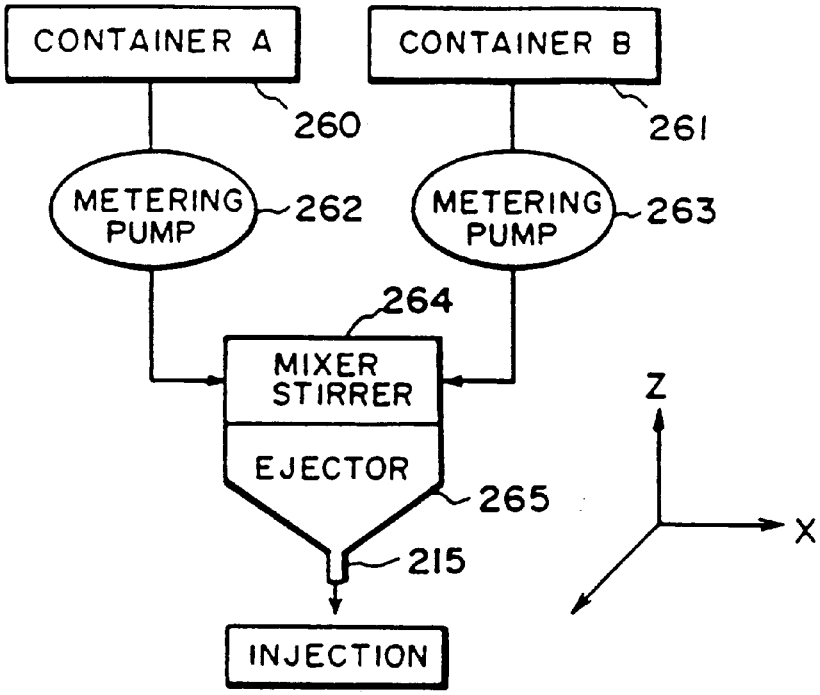
FIG. 15 schematically illustrates an injection system for the liquid elastomer.

In this embodiment, the liquid elastomer is dispensed to the coupling surface. Referring to FIG. 15, the description will be made as to the system for mixing the two-liquid-active material (liquid elastomer) and ejecting it through a nozzle 215.

In FIG. 15, liquid A and liquid B are contained in containers A60 and B61. They are metered by precise metering pumps 262 and 263 to a mixing and stirring station 264 so that the mixture ratio thereof are proper for the two-liquid reaction. In the mixing and stirring station 264, the liquid A and liquid B are uniformly mixed by the motor. It requires at least 30 sec approximately for the mixed liquid to solidify into an elastic elastomer, and therefore, the mixed liquid is ejected through a nozzle 215 of the ejector 265 in the middle of the reaction. The mixing and stirring station 264, the ejector 265 and an injection head including a nozzle 215 are moved along X-, Y-, and Z-axes to meet the configuration of the containers or the like, while the liquid elastomer is being ejected.

The metering by the metering pumps 262 and 263, the mixing and stirring speeds, movement of the ejecting head along the three axes, the ejecting speed or the like, are properly controlled in accordance with program set in a controller of an unshown industrial robot. Therefore, the injecting operation is carried out automatically.

The materials used are as follows.

TABLE 1

| | Liquid A | Liquid B | Foaming Rate (Vol.) | Solidified Elastomer |
|---|---|---|---|---|
| Ex. 1 | Polyol | Isocyante | 2–5 | Foaming Polyurethane (ISOACK Corporation) |
| | Mix. ratio: 10;2–3 | | | |
| Ex. 2 | (—OH) Silicone | (—H) Silicone | 2–10 | Foaming Silicone (TORAY SILICONE) |
| | Mix.ratio: 1:1 | | | |

Figure 16:
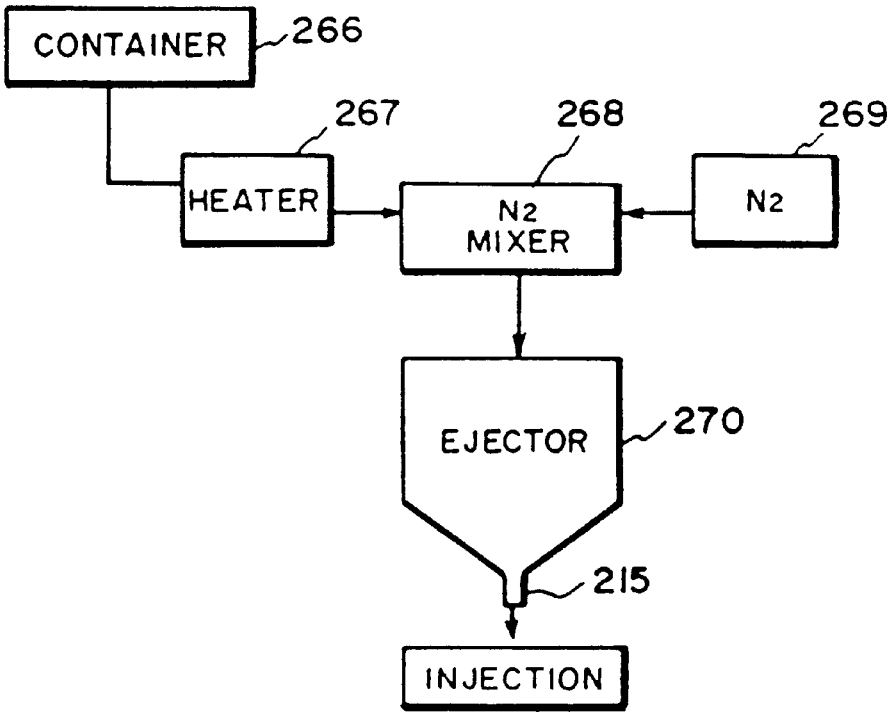
FIG. 16 is a schematic view of a liquid elastomer injection system.
Figure 17:
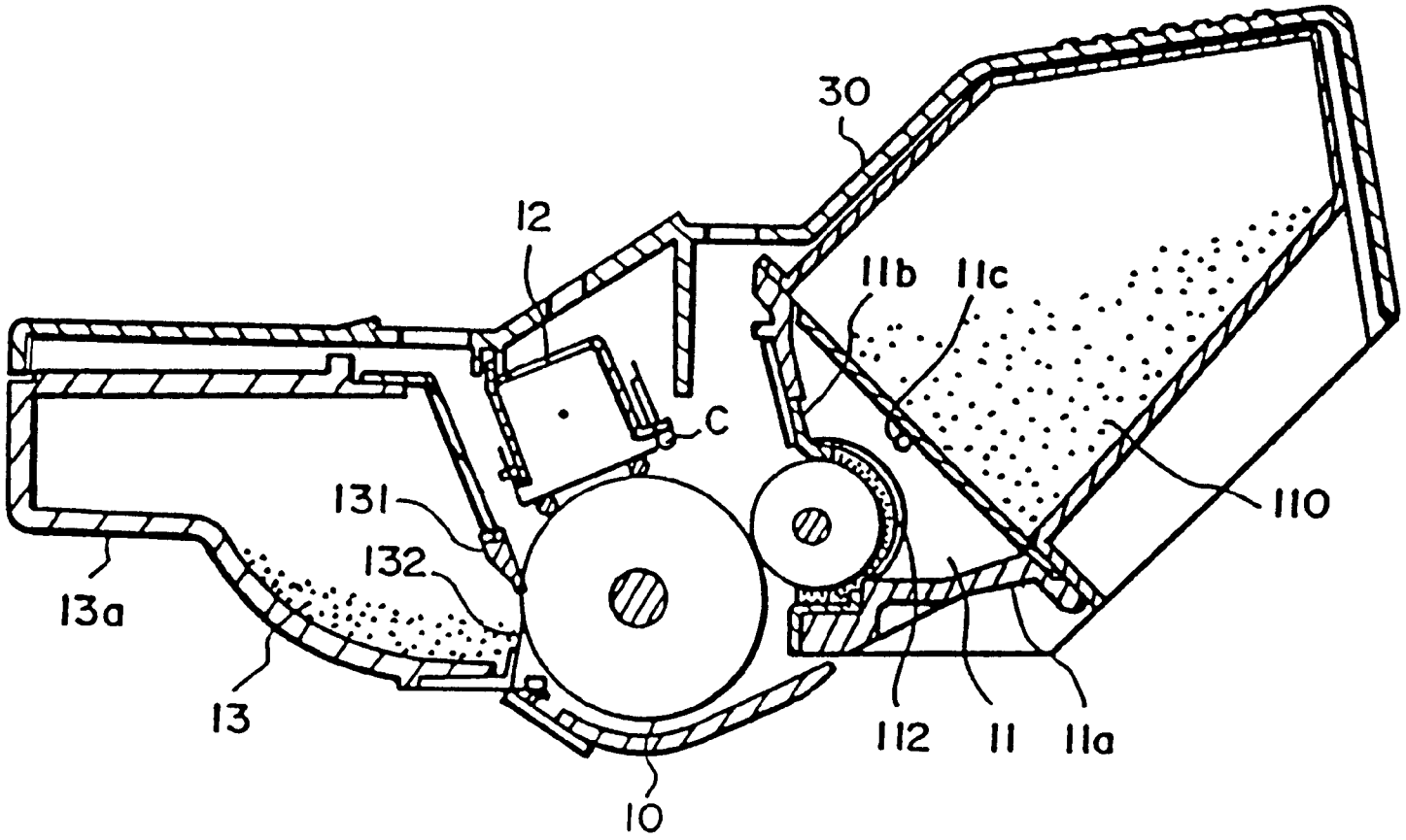
FIG. 17 PRIOR ART
FIG. 17 is a sectional view of a conventional process cartridge.

Referring to FIG. 16, the description will be made as to a system in which single-liquid reaction type liquid is used. A $N_2$ gas is injected into the liquid to foam it, and it is ejected through a nozzle 16.

In FIG. 16, a liquid elastomer mainly comprising polyurethane material is heated by a heater to 70° C.–100° C. in a container 266. It is supplied by a pump to a foam mixing machine 268. In the foam mixing machine 268, the liquid supplied from the container 266 is mixed with $N_2$ gas so as to be foamed. Before the liquid elastomer is solidified, it is ejected to the member such as the toner container or the like through the nozzle 215 of the ejection 270.

Similarly to the case of the two-liquid type material, an unshown industrial robot is used, so that the controller thereof properly controls the mixture of the $N_2$ gas, the supply of the material, the movement in the three axes directions of the injecting head and the injection speed or the like. Therefore, the injecting or dispensing operations are automatical.

The elastomer in this embodiment preferably has an elongation of 100–200%, a hardness (Asker C) hardness of 4–15, compression-restoration of not less than 90%.

In the foregoing, the description has been made as to the case of the process cartridge having both of the residual toner container for the cleaning means and the toner container for the developing means. The present invention is not limited to this, and the present invention is applicable to the process cartridge at least one of the containers.

As described in the foregoing, according to the embodiments of the present invention, the sealing member is constituted by solidifying the dispensed liquid elastomers for the plural connecting portions of the process cartridge developer container, and therefore, the leakage of the developer can be prevented more positively than conventional, and in addition, the present invention is advantageous in that the sealing can meet complicated connecting portions.

In addition, the automatic control for the liquid elastomer injection is possible, and therefore, the assembling operation of the process cartridge is made easier.

The process cartridge described in the foregoing may contain an image bearing member and at least one of process means actable directly or indirectly on the image bearing member. More particularly, the process cartridge may contain as a unit an electrophotographic photosensitive member and a charging means, developing means and/or cleaning means. The cartridge thus constituted is detachably mountable to an image forming apparatus such as copying machine or laser beam printer.

As described in the foregoing, according to the embodiments of the present invention, the process cartridge is divisible into frames, one of which contains an image bearing member and process means actable thereon, and the other of which contains a toner container having toner particles and/or residual toner container. They are assembled by putting them together, and thereafter, they may be disassembled.

Therefore, the present invention provides the following advantageous effects:

1. By selecting the frame containing the toner container (developer container), process cartridges having different service life and cross-sections can be easily produced:
2. The frame containing the image bearing member and the process means can be made the same so that the manufacturing management is made simpler: and 3. The process cartridge can be reused by collecting the used process cartridge (empty toner container), disassembling the frames, replacing worn parts and coupling the toner container refilled with the fresh toner.

According to the present invention, the process cartridge having the nature of easy assembling and an image forming apparatus usable therewith, can be provided.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to an image forming apparatus comprising:

a first frame having an electrophotographic photosensitive member and process means for acting on said photosensitive member;

a second frame, separably engageable with said first frame, having a developer accommodating portion for accommodating a developer to be used for developing a latent image formed on said photosensitive member; and a sealing member disposed at an engaging portion between said first frame and said second frame for preventing leakage of developer between said first frame and said second frame when said first frame and second frame are engaged;

wherein said first frame and second frame are separably engaged to constitute said process cartridge.

2. A process cartridge according to claim 1, wherein said second frame is provided with an exposure opening for permitting said photosensitive member in the form of a drum to be exposed to light from a main assembly of the image forming apparatus, when said process cartridge is mounted in the main assembly of the image forming apparatus.

3. A process cartridge according to claim 1, wherein said process means of said first frame includes developing means for developing a latent image on said photosensitive member using developer from said developer accommodating portion.

4. A process cartridge according to claim 2, wherein said process means of said first frame includes developing means for developing a latent image on said photosensitive member using developer from said developer accommodating portion.

5. A process cartridge according to claim 3, wherein said developing means includes a developer roller, and said developer accommodating portion is provided with a developer supply opening, which is sealed by a removable seal, and developer in said developer accommodating portion is supplied to said developer roller from said developer accommodating portion by removing the removable seal.

6. A process cartridge according to claim 4, wherein said developing means includes a developer roller, and said developer accommodating portion is provided with a developer supply opening, which is sealed by a removable seal, and developer in said developer accommodating portion is supplied to said developer roller from said developer accommodating portion by removing the removable seal.

7. A process cartridge according to claim 1, wherein said photosensitive member is a drum, and said process means of said first frame includes cleaning means for removing residual developer from said drum.

8. A process cartridge according to claim 2, wherein said photosensitive member is a drum, and said process means of said first frame includes cleaning means for removing residual developer from said drum.

9. A process cartridge according to claim 3, wherein said photosensitive member is a drum, and said process means of said first frame includes cleaning means for removing residual developer from said drum.

10. A process cartridge according to claim 4, wherein said photosensitive member is a drum, and said process means of said first frame includes cleaning means for removing residual developer from said drum.

11. A process cartridge according to claim 7, wherein said cleaning means includes a cleaning blade in contact with said photosensitive member to scrape residual developer off the photosensitive member.

12. A process cartridge according to claim 8, wherein said cleaning means includes a cleaning blade in contact with said photosensitive member to scrape residual developer off the photosensitive member.

13. A process cartridge according to claim 9, wherein said cleaning means includes a cleaning blade in contact with said photosensitive member to scrape residual developer off the photosensitive member.

14. A process cartridge according to claim 10, wherein said cleaning means includes a cleaning blade in contact with said photosensitive member to scrape residual developer off the photosensitive member.

15. A process cartridge according to claim 1, wherein said process means includes a contact type charging roller contactable to said photosensitive member to charge said photosensitive member.

16. A process cartridge according to claim 2, wherein said process means includes a contact type charging roller contactable to said photosensitive member to charge said photosensitive member.

17. A process cartridge according to claim 3, wherein said process means includes a contact type charging roller contactable to said photosensitive member to charge said photosensitive member.

18. A process cartridge according to claim 4, wherein said process means includes a contact type charging roller contactable to said photosensitive member to charge said photosensitive member.

19. A process cartridge according to any one of claims 1 to 4, 7 to 10, and 15 to 18, wherein said first frame and said second frame are separably engageable by elastic engagement means including an engaging member in one of said first frame and said second frame and an engagement opening in the other one of said first frame and said second frame.

20. A process cartridge according to claim 19, wherein a plurality of engaging members are provided on said second frame, and a plurality of respective engagement openings are provided in said first frame.

21. A process cartridge according to claim 20, wherein each of said plurality of engaging members has a hook portion at a bottom of said developer accommodating portion, each said hook portion being engageable with a respective engagement opening and deformable by an external force to be releasable from the engagement opening, by which said first frame and said second frame are separatable from each other.

22. A process cartridge according to claim 1, wherein said first frame and said second frame cooperate to constitute developer accommodating portion for accommodating developer removed from said photosensitive member by cleaning means as said process means.

23. A process cartridge according to claim 21, wherein said first frame and said second frame cooperate to constitute developer accommodating portion for accommodating developer removed from said photosensitive member by cleaning means as said process means.

24. A process cartridge according to claim 1, wherein said sealing member is made of foamed urethane, soft rubber or soft plastic material.

25. A process cartridge according to claim 21, wherein said sealing member is made of foamed urethane, soft rubber or soft plastic material.

26. A process cartridge according to claim 1, wherein said process cartridge is mounted to a main assembly of said image forming apparatus with said second frame at the top and said first frame at the bottom.

27. A process cartridge according to claim 21, wherein said process cartridge is mounted to a main assembly of said image forming apparatus with said second frame at the top and said first frame at the bottom.

28. A process cartridge according to claim 1, wherein said process cartridge integrally includes said photosensitive member and said process means, said process means comprising at least one of charging means, developing means and cleaning means, and wherein said process cartridge is detachably mountable to the image forming apparatus as a unit.

29. A process cartridge according to claim 21, wherein said process cartridge integrally includes said photosensitive member and said process means, said process means comprising at least one of charging means, developing means and cleaning means, and wherein said process cartridge is detachably mountable to the image forming apparatus as a unit.

30. A process cartridge detachably mountable to an image forming apparatus comprising:

a first frame having an electrophotographic photosensitive member, developing means for developing a latent image formed on said photosensitive member with a developer, and cleaning means for removing residual developer from said photosensitive member;

a second frame, separably engageable with said first frame, and including a developer accommodating portion for accommodating a developer for developing a latent image formed on said photosensitive member and an exposure opening for permitting said photosensitive member to be exposed to light from a main assembly of the image forming apparatus, when said process cartridge is mounted to a main assembly of the image forming apparatus; and a sealing member disposed at an engaging portion between said first frame and said second frame for preventing leakage of developer between said first frame and said second frame when said first frame and second frame are engaged;

wherein said first frame and second frame are separably engaged to constitute said process cartridge.

31. A process cartridge according to claim 30, wherein said developing means comprises a developer roller, and said developer accommodating portion is provided with a developer supply opening, which is sealed by a removable seal, and developer in said developer accommodating portion is supplied to the developer roller from said developer accommodating portion by removing the removable seal.

32. A process cartridge according to claim 30, wherein said cleaning means includes a cleaning blade in contact with said photosensitive member to scrape residual developer off the photosensitive member.

33. A process cartridge according to claim 30, wherein said process means includes a contact type charging roller contactable to said photosensitive member to charge said photosensitive member.

34. A process cartridge according to claim 31, wherein said process means includes a contact type charging roller contactable to said photosensitive member to charge said photosensitive member.

35. A process cartridge according to claim 32, wherein said process means includes a contact type charging roller contactable to said photosensitive member to charge said photosensitive member.

36. A process cartridge according to claim 30, wherein said first frame and said second frame are separably engaged by elastic engagement means including an engaging member on said second frame and an engagement opening on said first frame.

37. A process cartridge according to claim 31, wherein said first frame and said second frame are separably engaged by elastic engagement means including an engaging member on said second frame and an engagement opening on said first frame.

38. A process cartridge according to claim 32, wherein said first frame and said second frame are separably engaged by elastic engagement means including an engaging member on said second frame and an engagement opening on said first frame.

39. A process cartridge according to claim 36, wherein a plurality of engaging members are provided in said second frame, and a plurality of respective engagement openings are provided in said first frame.

40. A process cartridge according to claim 37, wherein a plurality of engaging members are provided in said second frame, and a plurality of respective engagement openings are provided in said first frame.

41. A process cartridge according to claim 38, wherein a plurality of engaging members are provided in said second frame, and a plurality of respective engagement openings are provided in said first frame.

42. A process cartridge according to any one of claims 39, 40 and 41, wherein each of said plurality of engaging members has a hook portion at a bottom of said developer accommodating portion, each said hook portion being engageable with a respective engagement opening provided in said first frame and deformable by an external force to be releasable from said respective engagement opening, by which said first frame and second frame are separable from each other.

43. A process cartridge according to claim 30, wherein said first frame and said second frame cooperate with said cleaning means to constitute a residual developer accommodating portion.

44. A process cartridge according to claim 30, wherein said sealing member is made of foamed urethane, soft rubber or soft plastic material.

45. A process cartridge detachably mountable to an image forming apparatus comprising:

a first frame having an electrophotographic photosensitive drum, a developing roller for developing a latent image formed on said photosensitive drum with a developer, and a cleaning blade for removing residual developer from said photosensitive drum;

a second frame, separably engageable with said first frame, including a developer accommodating portion for accommodating a developer to be used for developing a latent image formed on said photosensitive drum by said developing roller and an exposure opening for permitting said photosensitive drum to be exposed to light from a main assembly of the image forming apparatus when said process cartridge is mounted to the main assembly of the image forming apparatus; and a sealing member disposed at an engagement portion between said first frame and said second frame for preventing leakage of developer between said first frame and said second frame when said first frame and second frame are engaged;

wherein said first frame and said second frame are separably engaged to constitute said process cartridge, and wherein said first frame and second frame are separably engaged by an elastic engaging member on said second frame and an engagement opening on said first frame.

46. A process cartridge according to claim 45, wherein said developer accommodating portion is provided with a developer supply opening, which is sealed by a removable seal, and developer in said developer accommodating portion is supplied to said developer roller from said developer accommodating portion by removing the removable seal.

47. A process cartridge according to claim 45, wherein said cleaning blade is disposed in contact with said photosensitive drum to scrape residual developer off the photosensitive member.

48. A process cartridge according to claim 45, further comprising a contact type charging roller contactable to said photosensitive drum to charge said photosensitive drum.

49. A process cartridge according to claim 46, further comprising a contact type charging roller contactable to said photosensitive drum to charge said photosensitive drum.

50. A process cartridge according to claim 47, further comprising a contact type charging roller contactable to said photosensitive drum to charge said photosensitive drum.

51. A process cartridge according to claim 45, wherein said engaging member has a hook portion at a bottom of said developer accommodating portion, said hook portion being engageable with the engagement opening provided in said first frame and deformable by an external force to be releasable from the engagement opening, by which said first frame and said second frame are separable from each other.

52. A process cartridge according to claim 45, wherein said first frame and said second frame cooperate to constitute a residual developer accommodating portion for accommodating developer removed from said photosensitive drum by said cleaning blade.

53. A process cartridge according to claim 45, wherein said sealing member is made of foamed urethane, soft rubber or soft plastic material.

54. A process cartridge detachably mountable to an image forming apparatus comprising:

a first frame having an electrophotographic photosensitive member and developing means for developing a latent image formed on said photosensitive member with a developer;

a second frame, separably engageable with said first frame, and including a developer accommodating portion for accommodating developer for developing a latent image formed on said photosensitive member by said developing means, and an exposure opening for permitting said photosensitive member to be exposed to light from a main assembly of the image forming apparatus; and an engaging member for separably engaging said first frame and said second frame;

wherein said first frame and said second frame are separably engagable to constitute said process cartridge.

55. A process cartridge according to claim 54, wherein a sealing member is disposed in an engagement portion between said first frame and said second frame for preventing leakage of developer between said first frame and said second frame when said first frame and said second frame are engaged.

56. A process cartridge according to claim 54, wherein said developing means comprises a developer roller, and said developer accommodating portion is provided with a developer supply opening, which is sealed by a removable seal, and developer in said developer accommodating portion is supplied to the developer roller from said developer accommodating portion by removing the removable seal.

57. A process cartridge according to claim 55, wherein said developing means comprises a developer roller, and said developer accommodating portion is provided with a developer supply opening, which is sealed by a removable seal, and developer in said developer accommodating portion is supplied to the developer roller from said developer accommodating portion by removing the removable seal.

58. A process cartridge according to claim 54, wherein said photosensitive member is a drum, and said first frame further includes cleaning means for removing residual developer from said drum.

59. A process cartridge according to claim 55, wherein said photosensitive member is a drum, and said first frame further includes cleaning means for removing residual developer from said drum.

60. A process cartridge according to claim 58, wherein said cleaning means includes a cleaning blade in contact with said photosensitive member to scrape residual developer off the photosensitive member.

61. A process cartridge according to claim 59, wherein said cleaning means includes a cleaning blade in contact with said photosensitive member to scrape residual developer off the photosensitive member.

62. A process cartridge according to claim 54, wherein said developing means includes a developing roller for supplying the developer to said photosensitive member and a developing blade for regulating an amount of the developer deposited on a peripheral surface of said developing roller.

63. A process cartridge according to claim 55, wherein said developing means includes a developing roller for supplying the developer to said photosensitive member and a developing blade for regulating an amount of the developer deposited on a peripheral surface of said developing roller.

64. A process cartridge according to any one of claims 54, 55, 58, 59, 62, and 63, wherein said first frame and said second frame are separably engageable by an elastic engaging member on said second frame and an engagement opening on said first frame.

65. A process cartridge according to claim 64, wherein a plurality of engaging members are provided in said second frame, and a plurality of respective engagement openings are provided in said first frame.

66. A process cartridge according to claim 65, wherein each of said plurality of engaging members has a hook portion at a bottom of said developer accommodating portion, each said hook portion being engageable with a respective engagement opening and deformable by an external force to be releasable from the engagement opening, by which said first frame and said second frame are separable from each other.

67. A process cartridge according to claim 54, wherein said first frame further includes cleaning means, and wherein said first frame and said second frame cooperate to constitute a developer accommodating portion for accommodating developer removed from said photosensitive member by cleaning means as said process means.

68. A process cartridge according to claim 66, wherein said first frame further includes cleaning means, and said first frame and said second frame cooperate to constitute a developer accommodating portion for accommodating developer removed from said photosensitive member by cleaning means.

69. A process cartridge according to claim 55, wherein said sealing member is made of foamed urethane, soft rubber or soft plastic material.

70. A process cartridge according to claim 66, further comprising a sealing member for preventing leakage of developer between said first frame and said second frame when the first frame and second frame are engaged, wherein said sealing member is made of foamed urethane, soft rubber or soft plastic material.

71. A process cartridge according to claim 54, wherein said process cartridge is mounted to a main assembly of the image forming apparatus with said second frame at the top and said first frame at the bottom.

72. A process cartridge according to claim 66, wherein said process cartridge is mounted to a main assembly of the image forming apparatus with said second frame at the top and said first frame at the bottom.

73. A process cartridge according to claim 54, wherein said process cartridge further includes charging means for electrically charging said photosensitive member and cleaning means for removing residual developer remaining on said photosensitive member, and wherein said process cartridge is detachably mountable to the image forming apparatus as a unit.

74. A process cartridge according to claim 66, wherein said process cartridge further includes charging means for electrically charging said photosensitive member and cleaning means for removing residual developer remaining on said photosensitive member, and wherein said process cartridge is detachably mountable to the image forming apparatus as a unit.

75. A process cartridge detachably mountable to an image forming apparatus comprising:

a first frame having an electrophotographic photosensitive drum, a developing roller for developing a latent image formed on said photosensitive drum with a developer and a cleaning blade for removing residual developer from said photosensitive drum;

a second frame, separably engageable with said first frame, and including a developer accommodating portion for accommodating developer for developing a latent image formed on said photosensitive drum by said developing roller, and an exposure opening for permitting said photosensitive drum to be exposed to light from a main assembly of the image forming apparatus; and wherein said first frame and said second frame are separably engaged to constitute said process cartridge.

76. A process cartridge according to claim 75, wherein said developer accommodating portion is provided with a developer supply opening, which is sealed by a removable seal, and developer in said developer accommodating portion is supplied to the developer roller from said developer accommodating portion by removing the removable seal.

77. A process cartridge according to claim 75, wherein said cleaning blade is disposed in contact with said photosensitive drum to scrape residual developer off the photosensitive drum.

78. A process cartridge according to claim 75, further comprising a contact type charging roller contactable to said photosensitive drum to charge said photosensitive drum.

79. A process cartridge according to claim 76, further comprising a contact type charging roller contactable to said photosensitive drum to charge said photosensitive drum.

80. A process cartridge according to claim 77, further comprising a contact type charging roller contactable to said photosensitive drum to charge said photosensitive drum.

81. A process cartridge according to claim 75, wherein said first frame and said second frame are separably engaged by an elastic engaging member on said second frame and an engagement opening on said first frame.

82. A process cartridge according to claim 76, wherein said first frame and said second frame are separably engaged by an elastic engaging member on said second frame and an engagement opening on said first frame.

83. A process cartridge according to claim 77, wherein said first frame and said second frame are separably engaged by an elastic engaging member on said second frame, and an engagement opening on said first frame.

84. A process cartridge according to claim 81, wherein a plurality of engaging members are provided in said second frame, and a plurality of respective engagement openings are provided in said first frame.

85. A process cartridge according to claim 82, wherein a plurality of engaging members are provided in said second frame, and a plurality of respective engagement openings are provided in said first frame.

86. A process cartridge according to claim 83, wherein a plurality of engaging members are provided in said second frame, and a plurality of respective engagement openings are provided in said first frame.

87. A process cartridge according to any one of claims 84 to 86, wherein each of said plurality of engaging members has a hook portion at a bottom of said developer accommodating portion, each said hook portion being engageable with a respective engagement opening and deformable by an external force to be releasable from the engagement opening, by which said first frame and said second frame are separable from each other.

88. A process cartridge according to claim 75, wherein said first frame and said second frame cooperate with said cleaning blade to constitute a residual developer accommodating portion.

89. A process cartridge according to claim 76, wherein said removable seal is made of foamed urethane, soft rubber or soft plastic material.

90. A process cartridge detachably mountable to an image forming apparatus comprising:

a first frame having an electrophotographic photosensitive drum, a developing roller for developing a latent image formed on said photosensitive drum with a developer, and a cleaning blade disposed in contact with said photosensitive drum for removing residual developer from said photosensitive drum; and a second frame, separably engageable with said first frame, and including a developer accommodating portion for accommodating a developer for developing a latent image formed on said photosensitive drum by said developing roller and an exposure opening for permitting said photosensitive drum to be exposed to light from a main assembly of the image forming apparatus when said process cartridge is mounted to a main assembly of the image forming apparatus, said developer accommodating portion being provided with a developer supply opening, which is sealed by a removable seal, wherein developer in said developer accommodating portion is supplied to said developer roller from said developer accommodating portion by removing the removable seal;

wherein said first frame and said second frame are separably engageable to constitute said process cartridge, and wherein said first frame and said second frame are separably engageable by a plurality of elastic engaging members provided on said second frame, and a plurality of respective engagement openings provided in said first frame.

91. A process cartridge according to claim 90, wherein each of said plurality of engaging members has a hook portion at a bottom of said developer accommodating portion, each said hook portion being engageable with a respective engagement opening and deformable by an external force to be releasable from the opening frame, by which said first frame and said second frame are separated from each other.

92. A process cartridge according to claim 90, wherein said first frame and said second frame cooperate to constitute a residual developer accommodating portion for accommodating developer removed from said photosensitive drum by said cleaning blade.

93. A process cartridge according to claim 90, wherein said removable seal is made of foamed urethane, soft rubber or soft plastic material.

94. A removable frame for a process cartridge detachably mountable to an image forming apparatus, said removable frame being separably engageable with a process frame to constitute a process cartridge, said process frame having an electrophotographic photosensitive drum, a developing roller for developing a latent image formed on said photosensitive drum with a developer, a cleaning blade for removing residual developer from said photosensitive drum, and engaging means including an engagement opening, said removable frame comprising:

a developer accommodating portion for accommodating developer to be used by said developing means; and an elongated exposure opening for permitting said photosensitive drum to be exposed to light from a main assembly of the image forming apparatus, when said process cartridge is mounted to a main assembly of the image forming apparatus; and an engaging member for elastically engaging said engagement opening of said process frame for separable engagement therebetween.

95. A removable frame according to claim 94, wherein said engaging member includes a plurality of hook portions arranged on a bottom surface of said developer accommodating portion.

96. A removable frame for a process cartridge detachably mountable to an image forming apparatus, said removable frame being separably engageable with a process frame to constitute a process cartridge, said process frame having an electrophotographic photosensitive drum, a developing roller for developing a latent image formed on said photosensitive drum with a developer, a cleaning blade for removing residual developer from said photosensitive drum, and an engagement opening, said removable frame comprising:

a developer accommodating portion for accommodating developer to be used by said developing roller;

an elongated exposure opening for permitting said photosensitive drum to be exposed to light from a main assembly of said image forming apparatus, when said process cartridge is mounted to a main assembly of the image forming apparatus;

an engaging member for elastically engaging said engagement opening of said process frame, for separable engagement therebetween, wherein said engaging member includes a plurality of hook portions arranged on a bottom surface of said developer accommodating portion; and a sealing member mounting portion for mounting a sealing member disposed at an engaging portion between said process frame and said removable frame, for preventing leakage of developer between said process frame and said removable frame when said process frame and said removable frame are engaged.

97. A process frame for a process cartridge detachably mountable to an image forming apparatus, said process frame being separably engageable with a removable frame to constitute a process cartridge, said removable frame having a developer accommodating portion for accommodating a developer for developing a latent image formed on a photosensitive drum, an exposure opening for permitting said photosensitive drum to be exposed to light from a main assembly of the image forming apparatus, when said process cartridge is mounted to the main assembly of the image forming apparatus, and an engaging member, said process frame comprising:

a drum mounting portion for mounting said photosensitive drum;

a roller mounting portion for mounting a developing roller for developing a latent image on said photosensitive drum;

a blade mounting portion for mounting a cleaning blade for removing residual developer from said photosensitive drum; and an engagement opening elastically engageable with said engaging member of said removable frame for elastic engagement between said process frame and said removable frame.

98. A process frame according to claim 97, wherein a plurality of engagement openings are arranged along a longitudinal direction of said process frame.

99. A process frame for a process cartridge detachably mountable to an image forming apparatus, said process frame being separably engageable with a removable frame to constitute a process cartridge, said removable frame having a developer accommodating portion for accommodating a developer for developing a latent image formed on a photosensitive drum, an elongated exposure opening for permitting said photosensitive drum to be exposed to light from a main assembly of the image forming apparatus when said process cartridge is mounted to the main assembly of the image forming apparatus, and an engagement member, said process frame comprising:

a drum mounting portion for mounting a photosensitive drum;

a roller mounting portion for mounting a developing roller for developing a latent image on the photosensitive drum;

a magnet mounting portion for mounting a magnet in the developing roller;

a blade mounting portion for mounting a cleaning blade for removing residual developer from the photosensitive drum; and a plurality of engagement openings elastically engageable with an engaging member of said process frame, for elastic engagement between said process frame and said removable frame, said plurality of engagement openings being arranged along a longitudinal direction of the process frame.

100. A method of assembling a process cartridge detachably mountable to an image forming apparatus, comprising:

preparing a first frame having an electrophotographic photosensitive member and process means for acting on said photosensitive member;

preparing a second frame, separably engageable with said first frame, and including a developer accommodating portion for accommodating a developer for developing a latent image formed on said photosensitive member;

preparing a sealing member, disposable in an engaging portion between said first frame and said second frame, for preventing leakage of developer between said first frame and said second frame when said first frame and second frame are engaged; and separably engaging said first frame and said second frame with said sealing member disposed in the engaging portion.

101. A method according to claim 100, said engaging step comprising elastically engaging an engaging member of said second frame in an engagement opening of said first frame.

102. A method of assembling a process cartridge detachably mountable to an image forming apparatus, comprising:

preparing a first frame having an electrophotographic photosensitive member, developing means for developing a latent image formed on said photosensitive member with a developer, and cleaning means for removing residual developer from said photosensitive member;

preparing a second frame, separably engageable with said first frame, and including a developer accommodating portion for accommodating a developer to be used by said developing means and an exposure opening for permitting said photosensitive member to be exposed to light from a main assembly of the image forming apparatus, when said process cartridge is mounted to the main assembly of the image forming apparatus;

preparing a sealing member, disposable in an engaging portion between said first frame and said second frame, for preventing leakage of developer between said first frame and said second frame when said first frame and said second frame are engaged; and separably engaging said first frame and said second frame with said sealing member disposed in the engaging portion.

103. A method according to claim 102, said engaging step comprising elastically engaging an engaging member of said second frame in an engagement opening of said first frame.

104. A method of assembling a process cartridge detachably mountable to an image forming apparatus, comprising:

preparing a first frame having an electrophotographic photosensitive drum, a developing roller for developing a latent image formed on said photosensitive drum with a developer, and a cleaning blade for removing residual developer from said photosensitive drum;

preparing a second frame, separably engageable with said first frame, and including a developer accommodating portion for accommodating a developer for developing a latent image formed on said photosensitive drum and an exposure opening for permitting said photosensitive drum to be exposed to light from a main assembly of the image forming apparatus, when said process cartridge is mounted to the main assembly of the image forming apparatus;

preparing a sealing member, disposable in an engaging portion between said first frame and said second frame, for preventing leakage of developer between said first frame and said second frame when said first frame and said second frame are engaged; and separably and elastically engaging said first frame and said second frame with said sealing member therebetween.

105. A method of assembling a process cartridge detachably mountable to an image forming apparatus, comprising:

preparing a first frame having an electrophotographic photosensitive member and process means for acting on said photosensitive member and a plurality of engagement openings;

preparing a second frame, separably engageable with said first frame, and including a developer accommodating portion for accommodating a developer for developing a latent image formed on said photosensitive member and an exposure opening for permitting said photosensitive member to be exposed to light from a main assembly of said image forming apparatus, when said process cartridge is mounted to the main assembly of the image forming apparatus, and a plurality of engaging members;

preparing a sealing member, disposable in an engaging portion between said first frame and said second frame, for preventing leakage of developer between said first frame and said second frame when said first frame and said second frame are engaged; and separably engaging said first frame and said second frame with the sealing member disposed in an engaging portion therebetween, by engagement between said engaging members and said engagement openings.

106. A method according to claim 105, said engaging step comprising elastically engaging an engaging member of said second frame in an engagement opening of said first frame.

107. A method of assembling a process cartridge detachably mountable to an image forming apparatus, comprising:

preparing a first frame having an electrophotographic photosensitive drum, a developing roller for developing a latent image formed on said photosensitive drum with a developer, and a cleaning blade for removing residual developer from said photosensitive drum, and a plurality of engagement openings;

preparing a second frame, separably engageable with said first frame, and including a developer accommodating portion for accommodating a developer for developing a latent image formed on said photosensitive drum and an exposure opening for permitting said photosensitive drum to be exposed to light from a main assembly of said image forming apparatus, when said process cartridge is mounted to the main assembly of said image forming apparatus, and a plurality of engaging members;

preparing a sealing member, disposable in an engaging portion between said first frame and said second frame, for preventing leakage of developer between said first frame and said second frame when said first frame and said second frame are engaged; and separably engaging said first frame and said second frame with the sealing member disposed in an engaging portion therebetween, by engagement between said engaging members and said engagement openings.

108. A method according to claim 107, wherein said engaging step comprises elastically engaging an engaging member of said second frame in an engagement opening of said first frame.

109. A method of assembling a process cartridge detachably mountable to an image forming apparatus, comprising:

preparing a first frame having an electrophotographic photosensitive drum, a developing roller for developing a latent image formed on said photosensitive drum with a developer, and a cleaning blade for removing residual developer from said photosensitive drum, and a plurality of engagement openings;

preparing a second frame, separably engageable with said first frame, and including a developer accommodating portion for accommodating a developer for developing a latent image formed on said photosensitive drum by said developing roller and an exposure opening for permitting said photosensitive drum to be exposed to light from a main assembly of the image forming apparatus, when said process cartridge is mounted to the main assembly of the image forming apparatus, and a plurality of engaging members;

preparing a sealing member, disposable in an engaging portion between said first frame and said second frame, for preventing leakage of developer between said first frame and said second frame when said first frame and said second frame are engaged; and separably and elastically engaging said first frame and said second frame with said engaging members and said engagement openings, with said sealing member disposed therebetween.

110. An image forming apparatus for forming an image on a recording material, to which a process cartridge is detachably mountable, comprising:

a) mounting means for detachably mounting a process cartridge, said process cartridge including;

a first frame including an electrophotographic photosensitive member and process means for acting on said photosensitive member;

a second frame, separably engageable with said first frame, and including a developer accommodating portion for accommodating a developer for developing a latent image formed on said photosensitive member; and a sealing member disposed in an engaging portion between said first frame and said second frame, for preventing leakage of developer between said first frame and said second frame when said first frame and second frame are engaged;

wherein said first frame and said second frame are separably engagable to constitute said process cartridge;

b) transfer means for transferring a developed image formed on the electrophotographic photosensitive member in said process cartridge mounted on said mounting means onto a recording material;

c) fixing means for fixing an image transferred onto a recording material; and d) feeding means for feeding the recording material.

111. An image forming apparatus for forming an image on a recording material, and to which a process cartridge is detachably mountable, comprising:

a) mounting means for detachably mounting a process cartridge, said process cartridge including;

a first frame including an electrophotographic photosensitive member, developing means for developing a latent image formed on said photosensitive member with a developer, and cleaning means for removing residual developer from said photosensitive member;

a second frame, separably engageable with said first frame, and including a developer accommodating portion for accommodating a developer for developing a latent image formed on said photosensitive member and an exposure opening for permitting said photosensitive member to be exposed to light from a main assembly of the image forming apparatus, when said process cartridge is mounted to the main assembly of the image forming apparatus; and a sealing member disposed in an engaging portion between said first frame and said second frame, for preventing leakage of developer between said first frame and said second frame when said first frame and second frame are engaged;

wherein said first frame and said second frame are separably engagable to constitute said process cartridge;

b) transfer means for transferring a developed image formed on the electrophotographic photosensitive member in said process cartridge mounted on said mounting means onto a recording material;

c) fixing means for fixing an image transferred onto a recording material; and d) feeding means for feeding the recording material.

112. An image forming apparatus for forming an image on a recording material, and to which a process cartridge is detachably mountable, comprising:

a) mounting means for detachably mounting a process cartridge, said process cartridge including;

a first frame including an electrophotographic photosensitive drum, a developing roller for developing a latent image formed on said photosensitive drum with a developer, and a cleaning blade for removing residual developer from said photosensitive drum;

a second frame, separably engageable with said first frame, and including a developer accommodating portion for accommodating a developer for developing a latent image formed on said photosensitive drum and an exposure opening for permitting said photosensitive drum to be exposed to light from a main assembly of the image forming apparatus, when said process cartridge is mounted to the main assembly of the image forming apparatus; and a sealing member, disposed in an engaging portion between said first frame and said second frame, for preventing leakage of developer between said first frame and said second frame when said first frame and said second frame are engaged;

wherein said first frame and said second frame are separably engageable to constitute said process cartridge, and wherein said first frame and said second frame are separably engageable by an elastic engaging member on said second frame and an engagement opening on said first frame;

b) transfer means for transferring a developed image formed on the electrophotographic photosensitive drum in said process cartridge mounted on said mounting means onto a recording material;

c) fixing means for fixing an image transferred onto a recording material; and d) feeding means for feeding the recording material.

113. An image forming apparatus for forming an image on a recording material, and to which a process cartridge is detachably mountable, comprising:

a) mounting means for detachably mounting a process cartridge, said process cartridge including:

a first frame including an electrophotographic photosensitive member and developing means for developing a latent image formed on said photosensitive member with a developer;

a second frame, separably engageable with said first frame, and including a developer accommodating portion for accommodating developer for developing a latent image formed on said photosensitive member by said developing means, and an exposure opening for permitting said photosensitive member to be exposed to light from a main assembly of the image forming apparatus, when said process cartridge is mounted to the main assembly of the image forming apparatus; and an engaging member for separably engaging said first frame and said second frame;

wherein said first frame and said second frame are separably engagable to constitute said process cartridge;

b) transfer means for transferring a developed image formed on the electrophotographic photosensitive member in said process cartridge mounted on said mounting means onto a recording material;

c) fixing means for fixing an image transferred onto a recording material; and d) feeding means for feeding the recording material.

114. An image forming apparatus for forming an image on a recording material, and to which a process cartridge is detachably mountable, comprising:

a) mounting means for detachably mounting a process cartridge, said process cartridge including;

a first frame including an electrophotographic photosensitive drum, a developing roller for developing a latent image formed on said photosensitive drum with a developer, and a cleaning blade for removing residual developer from said photosensitive drum; and a second frame, separably engageable with said first frame, and including a developer accommodating portion for accommodating developer for developing a latent image formed on said photosensitive drum by said developing roller, and an exposure opening for permitting said photosensitive drum to be exposed to light from a main assembly of the image forming apparatus, when said process cartridge is mounted to the main assembly of the image forming apparatus;

wherein said first frame and said second frame are separably engagable to constitute said process cartridge;

b) transfer means for transferring a developed image formed on the electrophotographic photosensitive drum in said process cartridge mounted on said mounting means onto a recording material;

c) fixing means for fixing an image transferred onto a recording material; and d) feeding means for feeding the recording material.

115. An image forming apparatus for forming an image on a recording material, and to which a process cartridge is detachably mountable, comprising:

a) mounting means for detachably mounting a process cartridge, said process cartridge including;

a first frame including an electrophotographic photosensitive drum, a developing roller for developing a latent image formed on said photosensitive drum with a developer, and a cleaning blade disposed in contact with said photosensitive drum for removing residual developer from said photosensitive drum; and a second frame, separably engageable with said first frame, and including a developer accommodating portion for accommodating developer for developing a latent image formed on said photosensitive drum and an exposure opening for permitting said photosensitive drum to be exposed to light from a main assembly of the image forming apparatus, when said process cartridge is mounted to the main assembly of the image forming apparatus, said developer accommodating portion being provided with a developer supply opening, which is sealed by a removable seal, wherein developer in said developer accommodating portion is supplied to said developer roller from said developer accommodating portion by removing the removable seal, wherein said first frame and said second frame are separably engageable to constitute said process cartridge, and wherein said first frame and said second frame are separably engageable by a plurality of elastic engaging members provided on said second frame, and a plurality of respective engagement openings provided in said first frame;

b) transfer means for transferring a developed image formed on the electrophotographic photosensitive drum in said process cartridge mounted on said mounting means onto a recording material;

c) fixing means for fixing an image transferred onto a recording material; and d) feeding means for feeding the recording material.

116. A process cartridge detachably mountable to a main assembly of an electrophotographic image forming apparatus for forming an image on a recording material, comprising:

a first frame and a second frame;

said first frame including:

an electrophotographic photosensitive drum;

a developing roller for developing an electrostatic latent image formed on said photosensitive drum with a developer;

a cleaning blade, extended in a longitudinal direction of said photosensitive drum and disposed at a position across said photosensitive drum from said developing roller, for removing developer remaining on said photosensitive drum;

a transfer opening for permitting transfer of the image developed by said developing roller from said photosensitive drum onto the recording material;

a plurality of first engaging members disposed in a side adjacent said developing roller;

a plurality of second engaging members disposed in a side adjacent said cleaning blade;

said second frame including:

a developer accommodating portion for accommodating the developer to be used by said developing roller;

an exposure opening for permitting said photosensitive drum to be exposed with image information from exposure means of the main assembly when said process cartridge is mounted to the main assembly;

a plurality of elastic first hook members disengageably engageable with said first engaging members;

a plurality of elastic second hook members disengageably engageable with said second engaging members and disposed in a side opposite from said developer accommodating portion with respect to said exposure opening;

wherein said second frame is engageable with said first frame so as to cover a portion above said photosensitive drum and said developing roller; and wherein when said first frame and said second frame are coupled to form the process cartridge, said first frame and said second frame cooperate with each other, whereby a container for containing the developer removed by said cleaning blade from said photosensitive drum is constituted.

117. A process cartridge according to claim 116, wherein said first hook members are disposed below said developer accommodating portion in a longitudinal direction of said developer accommodating portion, and wherein said first hook members are disengageably engageable with openings functioning as said first engaging members, and wherein ends of said first hook members are faced to a side opposite from a side where said exposure opening is disposed.

118. A process cartridge according to claim 116, wherein said second hook members are arranged in a longitudinal direction of said first frame, and wherein ends of said second hook members are faced to a side where said exposure opening is disposed.

119. A process cartridge according to claim 118, wherein said second hook members are disengageably engageable with openings functioning as said second engaging members.

120. A process cartridge according to claim 116, further comprising a charging member for charging said photosensitive drum.

121. A process cartridge according to claims 116, 118, or 120, wherein said first frame and said second frame are engaged with each other with a sealing member for preventing leakage of the developer therebetween.

122. A process cartridge according to claim 116, wherein said first frame and said second frame are fixed by screws.

123. A process cartridge according to claim 122, wherein said first frame and said second frame are made of a plastic material.

124. A process cartridge according to claim 116, wherein when said process cartridge is mounted to the main assembly of said image forming apparatus, whereby said second frame takes an upper position and said first frame takes a lower position.

125. An image forming apparatus for forming an image on a recording material, to which a process cartridge is detachably mountable, comprising:

mounting member for detachably mounting a process cartridge, said process cartridge comprising a first frame and a second frame;

said first frame including:

a photosensitive drum;

a developing roller for developing an electrostatic latent image formed on said photosensitive drum with a developer;

a cleaning blade, extended in a longitudinal direction of said photosensitive drum and disposed at a position across said photosensitive drum from said developing roller, for removing developer remaining on said photosensitive drum;

a transfer opening for permitting transfer of the image developed by said developing roller from said photosensitive drum onto the recording material;

a plurality of first engaging members disposed in a side adjacent said developing roller;

a plurality of second engaging members disposed in a side adjacent said cleaning blade;

said second frame including:

a developer accommodating portion for accommodating developer to be used by said developing means;

an exposure opening for permitting said photosensitive drum to be exposed with image information from exposure means of the main assembly when said process cartridge is mounted to the main assembly;

a plurality of elastic first hook members disengageably engageable with said first engaging members;

a plurality of elastic second hook members disengageably engageable with said second engaging members and disposed in a side opposite from said developer accommodating portion with respect to said exposure opening;

wherein said second frame is engageable with said first frame so as to cover a portion above said photosensitive drum and said developing roller; and wherein when said first frame and said second frame are coupled to form the process cartridge, said first frame and said second frame cooperate with each other, whereby a container for containing the developer removed by said cleaning means from said photosensitive drum is constituted;

transfer member for transferring the developed image from said photosensitive drum onto the recording material; and contact with said photosensitive member to scrape residual developer off the photosensitive member.

* * * * *

UNITED STATES PATENT AND TRADEMARK OFFICE

CERTIFICATE OF CORRECTION

PATENT NO. : 6,118,961 
DATED : September 12, 2000
INVENTOR(S) : Yoshiya Nomura et al.

It is certified that error appears in the above-identified patent and that said Letters Patent is hereby corrected as shown below:

Title page,
Item [56], References Cited, FOREIGN PATENT DOCUMENTS,
"2123376 5/1990 Japan
2163769 6/1990 Japan
2168277 6/1990 Japan"
should read
-- 2-123376 5/1990 Japan
2-163769 6/1990 Japan
2-168277 6/1990 Japan --.

Column 3,
Line 61, "openings roller from the developer" should read -- openings being arranged along a longitudinal direction of the process frame. --.
Lines 62-67 should be deleted.

Column 4,
Lines 1-3 should be deleted.

Column 6,
Line 6, "the" should be deleted; and "FIG, 3" should read -- FIG. 3, a --.
Line 35, "123b, which" should read -- 123b --.

Column 7,
Line 11, "are" should read -- is --.

Column 8,
Line 9, "are" should read -- is --.
Line 19, "pawl" should read -- pawls --.
Line 28, "in" should read -- an --.

Column 11,
Line 39, "are" should read -- is --.

UNITED STATES PATENT AND TRADEMARK OFFICE

CERTIFICATE OF CORRECTION

PATENT NO. : 6,118,961
DATED : September 12, 2000
INVENTOR(S) : Yoshiya Nomura et al.

It is certified that error appears in the above-identified patent and that said Letters Patent is hereby corrected as shown below:

Column 12,
Line 28, "at" should read -- of at --.

Signed and Sealed this

Seventh Day of January, 2003

JAMES E. ROGAN
*Director of the United States Patent and Trademark Office*